US012758081B2

(12) United States Patent
Jung et al.

(10) Patent No.: US 12,758,081 B2
(45) Date of Patent: Oct. 13, 2026

(54) DISHWASHER

(71) Applicant: LG Electronics Inc., Seoul (KR)

(72) Inventors: Chang Yoon Jung, Seoul (KR); Gyu Han Hwang, Seoul (KR); Byeong Hyeon Ju, Seoul (KR)

(73) Assignee: LG Electronics Inc., Seoul (KR)

( * ) Notice: Subject to any disclaimer, the term of this patent is extended or adjusted under 35 U.S.C. 154(b) by 190 days.

(21) Appl. No.: 18/887,746

(22) Filed: Sep. 17, 2024

(65) Prior Publication Data

US 2025/0089980 A1 Mar. 20, 2025

(30) Foreign Application Priority Data

Sep. 18, 2023 (KR) ..... 10-2023-0124182

(51) Int. Cl.
*A47L 15/48* (2006.01)
*A47L 15/42* (2006.01)

(52) U.S. Cl.
CPC ..... *A47L 15/481* (2013.01); *A47L 15/4214* (2013.01); *A47L 15/4229* (2013.01); *A47L 15/486* (2013.01); *A47L 15/488* (2013.01)

(58) Field of Classification Search
None
See application file for complete search history.

(56) References Cited

U.S. PATENT DOCUMENTS

| | | | |
|---|---|---|---|
| 8,709,171 | B2 | 4/2014 | Jerg et al. |
| 8,858,727 | B2 | 10/2014 | Jerg et al. |
| 8,961,705 | B2 | 2/2015 | Jerg et al. |
| 9,661,981 | B2 | 5/2017 | Classen et al. |

FOREIGN PATENT DOCUMENTS

| | | | |
|---|---|---|---|
| CN | 206603750 | U | 11/2017 |
| CN | 209091300 | U | 7/2019 |
| DE | 102015211197 | A1 | 12/2016 |

OTHER PUBLICATIONS

Extended European Search Report in European Appln. No. 24199480.5, mailed on Jan. 24, 2025, 8 pages.

*Primary Examiner* — Rita P Adhlakha
(74) *Attorney, Agent, or Firm* — Fish & Richardson P.C.

(57) ABSTRACT

The present invention relates to a dishwasher in which a blowing part, a heater part, and a absorbent, which constitute a sorption drying device, are arranged between a sump and a rear surface of a base so as to be as close as possible to the rear surface of the base and arranged in a long line in a leftward/rightward direction, such that the sorption drying device may effectively serve as a counterweight for preventing the dishwasher from falling over, and a volume and weight of a weight balance additionally provided may be reduced.

20 Claims, 16 Drawing Sheets

DISHWASHER

CROSS-REFERENCE TO RELATED APPLICATION

This application claims priority to and benefit of Korean Patent Application No. 10-2023-0124182, filed on Sep. 18, 2023, which is hereby incorporated by reference as when fully set forth herein.

BACKGROUND

Technical Field

The present invention relates to a dishwasher, and more particularly, to a dishwasher in which a blowing part, a heater part, and a moisture absorbent, which constitute a moisture sorption drying device, are arranged between a sump and a rear surface of a base so as to be as close as possible to the rear surface of the base and arranged in a long line in a leftward/rightward direction, such that the moisture sorption drying device may effectively serve as a counterweight for preventing the dishwasher from falling over, and a volume and weight of a weight balance additionally provided may be reduced.

Background Art

A dishwasher refers to a device that washes washing targets, such as dishes and cookware, contained in the dishwasher by spraying washing water, such as water, to the washing targets. In this case, the washing water used for a washing process may include a detergent.

In general, the dishwasher includes a washing tub configured to define a washing space, an accommodation part disposed in the washing tub and configured to accommodate the washing targets, a spray arm configured to spray the washing water to the accommodation part, and a sump configured to store water and supply the washing water to the spray arm.

The use of the dishwasher may contribute to user convenience by reducing the time and effort required to wash washing targets, such as dishes, after a meal.

Typically, the dishwasher may be configured to perform a washing operation of washing the washing target, a rinsing operation of rinsing the washing target, and a drying operation of drying the washing target completely washed and rinsed.

Recently, dishwashers have been introduced, which include a moisture absorption device that may absorb moisture contained in air discharged from a tub and resupply the air into the tub during the drying operation to reduce the time required to dry the washing target.

In this regard, U.S. Pat. No. 9,661,981 (Patent Document 001) discloses a dishwasher including a moisture absorption device that removes moisture contained in air discharged from a tub and resupplies the air into the tub.

In the dishwasher of Patent Document 001, a suction port, through which air is discharged from the tub, is penetratively formed in a left surface of the tub, the moisture absorption device, which includes a moisture absorbent, a heater part, and the like, is accommodated in a base so as to be very adjacent to the left surface of the tub, and a discharge port, through which air from which moisture is removed is discharged, is penetratively formed in a lower surface of the tub so as to be very adjacent to the left surface of the tub.

DOCUMENT OF RELATED ART

Patent Document (Patent Document 001) U.S. Pat. No. 9,661,981

DISCLOSURE

Technical Problem

The moisture absorption device disclosed in Patent Document 001 is disposed to be biased toward the left side of the dishwasher based on a horizontal direction.

Because the moisture absorption device of the dishwasher disclosed in Patent Document 001 is disposed to be biased toward the left side as described above, the moisture absorption device cannot effectively serve as a counterweight for preventing the dishwasher from falling over by a load applied to a door when the door is fully opened, which causes a problem in that a weight balance having a significant weight needs to be additionally provided to prevent the dishwasher from falling over.

In addition, in the dishwasher disclosed in Patent Document 001, the moisture absorption device, which has a significant weight ratio compared to other objects accommodated in the base, applies an eccentric weight to the dishwasher, which causes a problem in that noise and vibration, which are generated during the operation of the dishwasher, are highly likely to become severe.

The present invention has been made in an effort to solve the above-mentioned problems in the related art, and a first object of the present invention is to provide a dishwasher in which a blowing part, a heater part, and a moisture absorbent, which constitute a moisture sorption drying device, are arranged between a sump and a rear surface of a base so as to be as close as possible to the rear surface of the base and arranged in a long line in a leftward/rightward direction, such that the moisture sorption drying device may effectively serve as a counterweight for preventing the dishwasher from falling over, and a volume and weight of a weight balance additionally provided may be reduced.

A second object of the present invention is to provide a dishwasher in which a moisture absorbent is disposed to be closer to the other side surface of the base than the sump based on the leftward/rightward direction to minimize weight eccentricity that may be caused by a water jacket disposed on one side surface of the base, and constituent components are disposed in consideration of a weight distribution in a forward/rearward direction and the leftward/rightward direction to minimize vibration and noise that are highly likely to be generated by the weight eccentricity.

The objects of the present invention are not limited to the above-mentioned objects, and other objects and advantages of the present invention, which are not mentioned above, may be understood from the following descriptions and more clearly understood from the embodiment of the present invention. In addition, it can be easily understood that the objects and advantages of the present invention may be realized by means defined in the claims and a combination thereof.

Technical Solution

A dishwasher according to the present invention may include: a tub having a washing space therein; a base disposed below the tub and configured to define a predetermined installation space; a moisture sorption drying device accommodated in the installation space and configured to absorb moisture from air discharged from the tub and resupply the air into the tub; and a sump accommodated in the installation space and configured to store washing water to be provided to the washing space, in which the moisture sorption drying device includes: a blowing part configured to generate an airflow by accelerating the air discharged from the tub; a heater part configured to heat the air having passed through the blowing part; and a moisture absorbent configured to absorb water vapor contained in the air having passed through the heater part, and in which the blowing part, the heater part, and the moisture absorbent are disposed in the installation space based on a forward/rearward direction so as to be arranged between the sump and a rear surface of the base in a leftward/rightward direction.

In addition, the blowing part, the heater part, and the moisture absorbent may be arranged in this order while being disposed in the leftward/rightward direction from one side surface of the base toward the other side surface disposed to be opposite to one side surface.

In addition, the moisture sorption drying device may further include a housing having a heater accommodation portion for accommodating the heater part, and a moisture absorbent accommodation portion for accommodating the moisture absorbent, and the moisture absorbent accommodation portion may be disposed to be closer to the other side surface of the base than the sump based on the leftward/rightward direction.

In addition, the installation space may include: a first space formed between the other side surface of the base and an imaginary vertical plane passing through a center of the sump and extending in the forward/rearward direction; and a second space formed between the imaginary vertical plane and one side surface of the base, and the moisture absorbent accommodation portion may be disposed in the first space as a whole.

In addition, the blowing part may be disposed in the second space as a whole, a part of the heater part may be disposed in the first space, and the remaining part of the heater part may be disposed in the second space.

In addition, the dishwasher may further include: a washing pump configured to pressurize the washing water stored in the sump and supply the washing water to the washing space, in which the washing pump is disposed in the first space together with the moisture absorbent accommodation portion.

In addition, the dishwasher may further include: a weight balance accommodated in the installation space and disposed between the moisture sorption drying device and the rear surface of the base, in which a weight of the weight balance is smaller than a weight of the moisture sorption drying device.

In addition, a volume of the moisture absorbent accommodation portion may be smaller than a volume of the weight balance.

In addition, a center of gravity of the weight balance and a center of gravity of the moisture sorption drying device may be provided to be closer to the other side surface of the base than one side surface of the base based on the leftward/rightward direction.

In addition, the center of gravity of the moisture sorption drying device may be formed on the moisture absorbent accommodation portion.

In addition, a weight of the moisture absorbent accommodated in the moisture absorbent accommodation portion may be within a range of 0.8 to 2 kg.

In addition, a weight of the moisture absorbent accommodated in the moisture absorbent accommodation portion may be within a range of 1 to 1.8 kg.

In addition, the dishwasher may further include: a water jacket disposed outside one side surface of the tub and configured to store the washing water; and a water softening device configured to soften the washing water stored in the water jacket and washing water provided from an external water supply source and provide the washing water to the sump, in which the water jacket is coupled to one side surface of the tub and extends in a downward direction toward the other side surface of the base, and in which the water softening device is disposed between the water jacket and the sump based on the leftward/rightward direction.

In addition, a capacity of the washing water discharged from the water softening device or stored in the water jacket may be within a range of 1 to 2 liters.

In addition, the capacity of the washing water discharged from the water softening device or stored in the water jacket may be less than 2 liters.

In addition, the tub may have an air suction hole through which air to be introduced into the blowing part passes, and an air supply hole through which air having passed through the moisture absorbent passes, the air suction hole may be formed in one side surface of the tub, and the air supply hole may be formed in a lower surface of the tub.

In addition, the air suction hole may be formed at a position on one side surface of the tub that is closer to a rear surface of the tub than the sump.

In addition, the air supply hole may be formed at a position on the lower surface of the tub that is closer to a rear surface of the tub than the sump.

Advantageous Effect

According to the dishwasher according to the present invention, the moisture sorption drying device may effectively serve as the counterweight for preventing the dishwasher from falling over.

In addition, according to the dishwasher according to the present invention, it is possible to reduce the volume and weight of the weight balance provided to prevent the dishwasher from falling over.

In addition, according to the dishwasher according to the present invention, the moisture absorbent and the moisture absorbent housing of the moisture sorption drying device are disposed to be opposite to the water jacket based on the sump, which may minimize the weight eccentricity, disperse the weight, and minimize the occurrence of the vibration and noise.

The specific effects of the present invention, together with the above-mentioned effects, will be described along with the description of specific items for carrying out the present invention.

MODE FOR INVENTION

Figure 1:
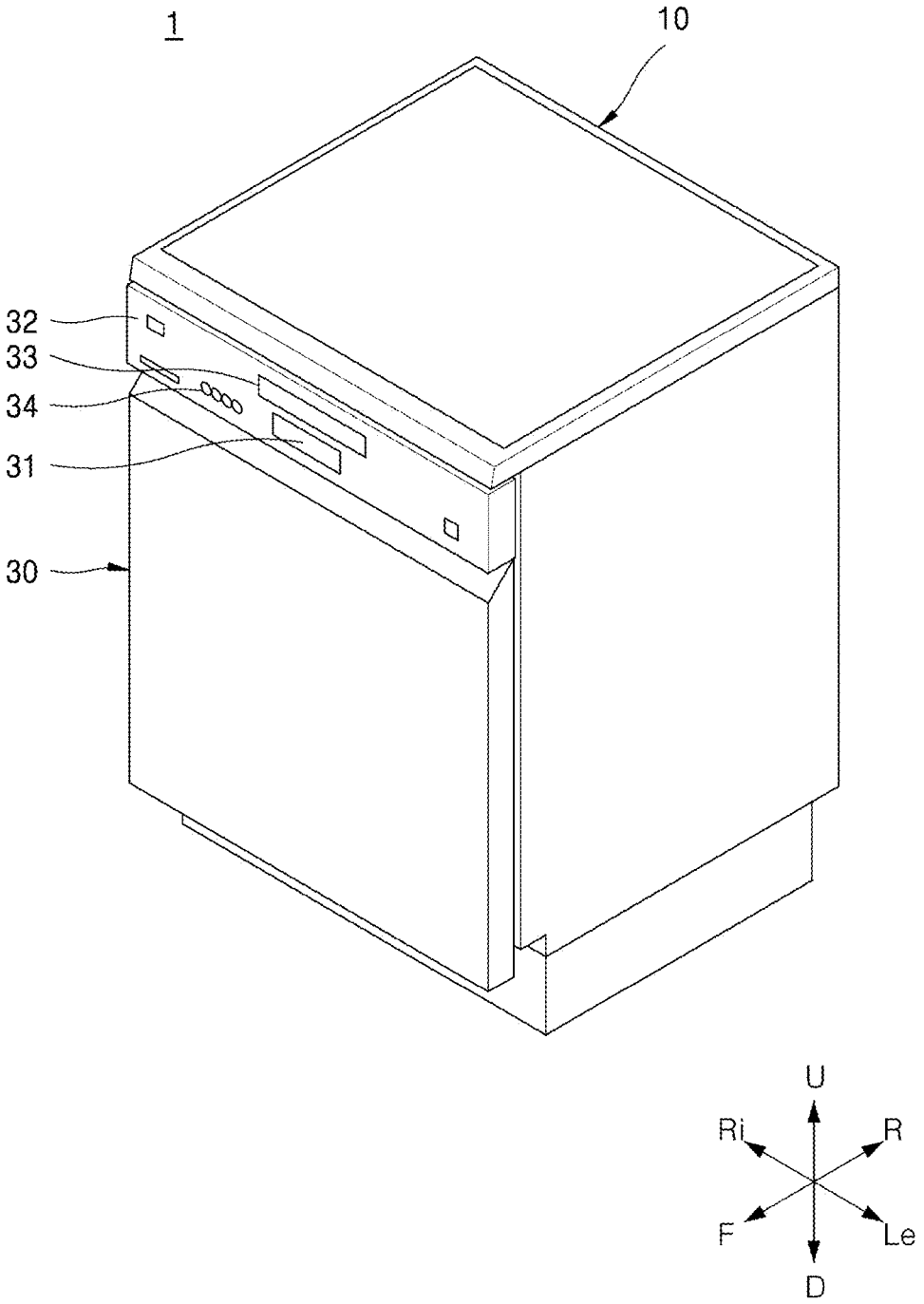
FIG. 1 is a front perspective view of a dishwasher according to an embodiment of the present invention.

The above-mentioned objects, features, and advantages will be described in detail below with reference to the accompanying drawings, and thus the technical spirit of the present invention will be easily carried out by those skilled in the art to which the present invention pertains. In the description of the present invention, the specific descriptions of publicly known technologies related with the present invention will be omitted when it is determined that the specific descriptions may unnecessarily obscure the subject matter of the present invention. Hereinafter, exemplary embodiments of the present invention will be described in detail with reference to the accompanying drawings. In the drawings, the same reference numerals are used to indicate the same or similar constituent elements.

Terms "first", "second", and the like may be used to describe various constituent elements, but the constituent elements are of course not limited by these terms. These terms are merely used to distinguish one constituent element from another constituent element. Therefore, unless explicitly described to the contrary, the first constituent element may, of course, be the second constituent element.

Throughout the specification, unless explicitly described to the contrary, the respective constituent elements may each be singular or plural.

Hereinafter, a configuration in which any component is disposed "above (below)" a constituent element or disposed on "an upper portion (or a lower portion)" of a constituent element may not only mean that any component is disposed to adjoin an upper surface (or a lower surface) of the constituent element, but also mean that another component may be interposed between the constituent element and any component disposed above (or below) the constituent element.

In addition, when one constituent element is described as being "connected," "coupled," or "attached" to another constituent element, it should be understood that the constituent elements may be connected or attached directly to each other, and an intervening constituent element may be "interposed" between the constituent elements, or the constituent elements may be "connected," "coupled," or "attached" to each other by an intervening constituent element.

Singular expressions used in the present specification include plural expressions unless clearly described as different meanings in the context. It should not be interpreted that the terms "comprises," "comprising," "includes" and/or "including," used herein necessarily include all of the several constituent elements or several steps disclosed in the present specification, and it should be interpreted that the terms do not include some of the constituent elements or steps and may further include additional constituent elements or steps.

In addition, singular expressions used in the present specification include plural expressions unless clearly described as different meanings in the context. It should not be interpreted that the terms "comprises," "comprising," "includes" and/or "including," used herein necessarily include all of the several constituent elements or several steps disclosed in the present specification, and it should be interpreted that the terms do not include some of the constituent elements or steps and may further include additional constituent elements or steps.

Throughout the specification, "A and/or B" means A, B, or A and B unless explicitly described to the contrary, and "C to D" means C or more and D or less unless explicitly described to the contrary.

Hereinafter, the present invention will be described with reference to the drawings illustrating configurations according to the embodiment of the present invention.

Overall Structure of Dishwasher

Hereinafter, an overall structure of a dishwasher 1 according to an embodiment of the present invention will be described in detail with reference to the accompanying drawings.

Figure 2:
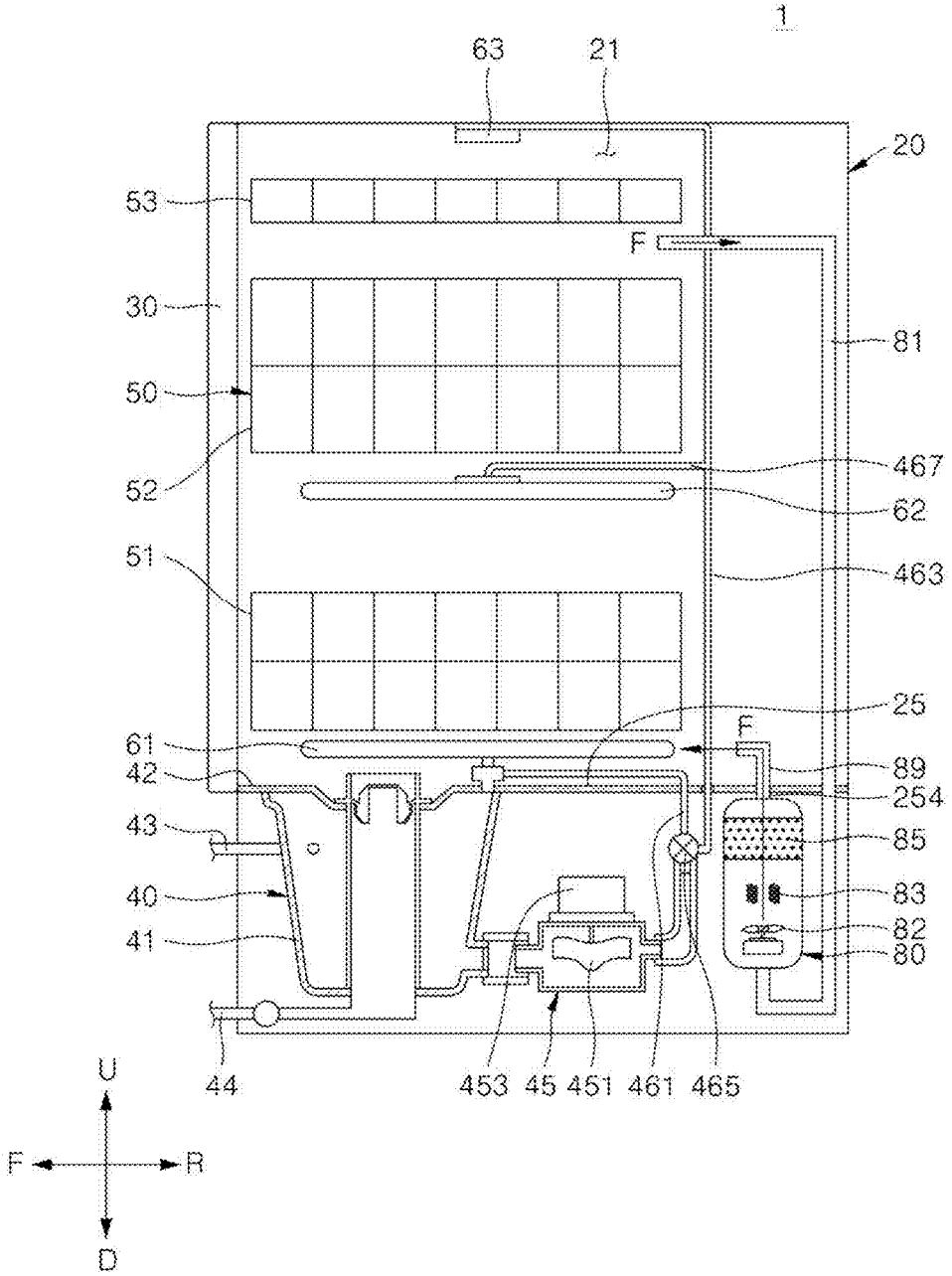
FIG. 2 is a schematic cross-sectional view of the dishwasher illustrated in FIG. 1.
Figure 3:
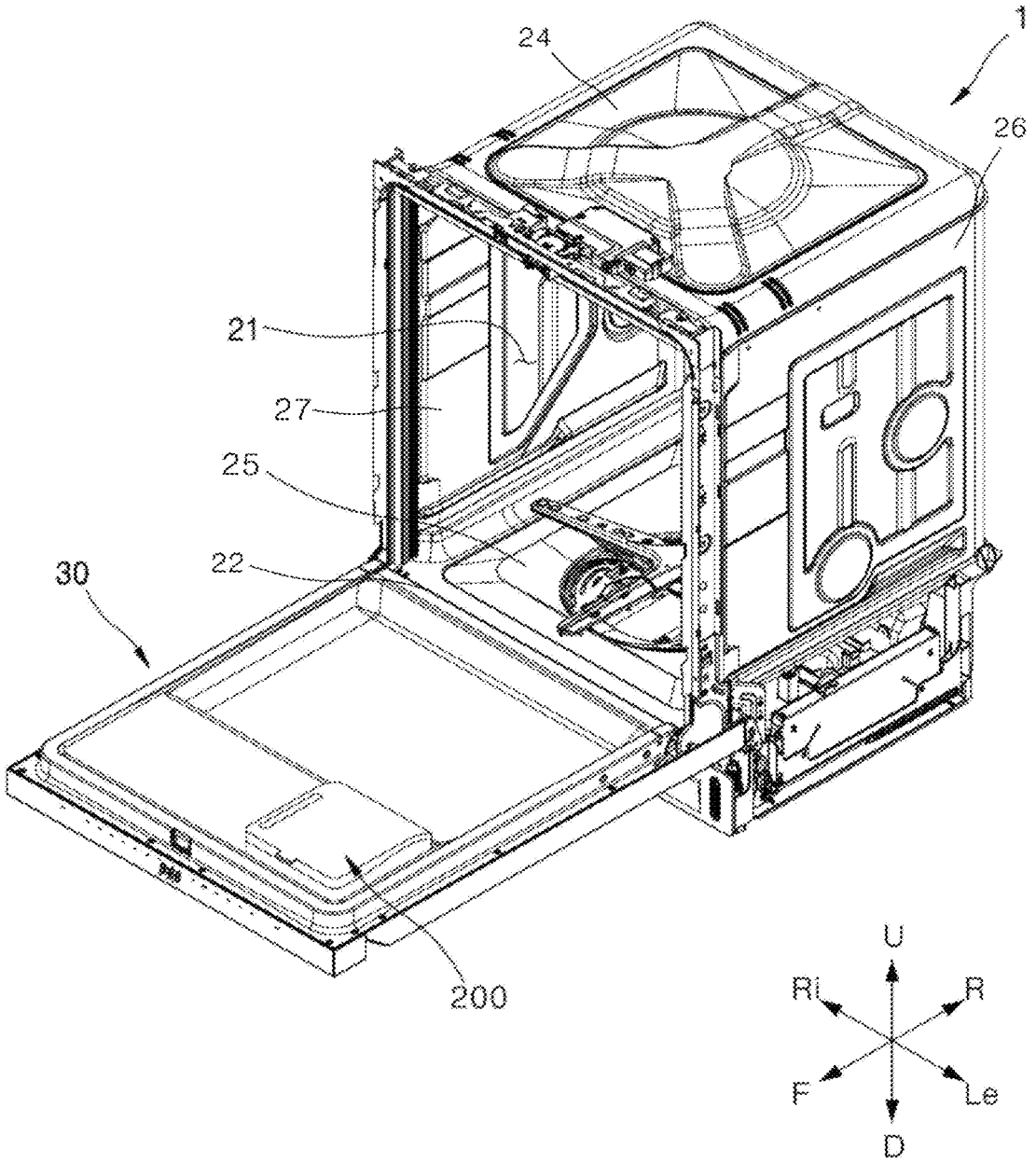
FIG. 3 is a front perspective view illustrating a state in which a door of the dishwasher illustrated in FIG. 1 is opened.

FIG. 1 is a front perspective view illustrating the dishwasher according to the present invention, FIG. 2 is a schematic cross-sectional view briefly illustrating an internal structure of the dishwasher according to the present invention, and FIG. 3 is a front perspective view illustrating a state in which a door 30 of the dishwasher 1 illustrated in FIG. 1 is opened.

As illustrated in FIGS. 1 to 3, the dishwasher 1 according to the present invention includes a casing 10 configured to define an external shape, a tub 20 installed in the casing 10, configured to define a washing space 21 in which a washing target is washed, and having an opened front side, the door 30 configured to open or close the opened front side of the tub 20, a drive part 40 positioned below the tub 20 and configured to supply, collect, circulate, and drain washing water used to wash the washing target, an accommodation part 50 detachably provided in the washing space 21 in the tub 20 and configured such that the washing target is seated in the accommodation part 50, and a spray part disposed adjacent to the accommodation part 50 and configured to spray the washing water used to wash the washing target.

In this case, for example, the washing targets seated in the accommodation part 50 may be dishes, such as bowls, plates, spoons, and chopsticks, and other cookware. Hereinafter, the washing target will be referred to as the dish unless otherwise stated.

The tub 20 may be formed in a box shape having a front side entirely opened and correspond to a component known as a so-called washing tub.

The washing space 21 may be formed in the tub 20, and the opened front side may be opened or closed by the door 30.

The tub 20 may be formed by pressing a metal plate highly resistant to a high temperature and moisture, for example, a board made of a material such as a stainless steel.

In addition, a plurality of brackets may be disposed on an inner surface of the tub 20, and the plurality of brackets serves to support and install functional components, such as the accommodation part 50 and the spray part to be described below, in the tub 20.

Meanwhile, the drive part 40 may include a sump 41 configured to store the washing water, a sump cover 42 configured to separate the sump 41 from the tub 20, a water supply part 43 configured to supply the washing water to the sump 41 from the outside, a water discharge part 44 configured to discharge the washing water in the sump 41 to the outside, and a washing pump 45 and a supply channel 46 configured to supply the washing water in the sump 41 to the spray part.

The water supply part 43 serves to supply the washing water, which is supplied from an external water supply source, to the sump 41.

As described below, the water supply part 43 may include a water jacket 110 configured to store the washing water supplied from the external water supply source, and a water softening device 72 or water purification filter (not illustrated) configured to soften the washing water stored in the water jacket.

The sump cover 42 may be disposed above the sump 41 and serve to separate the tub 20 and the sump 41. In addition, the sump cover 42 may have a plurality of recovery holes for recovering the washing water, which is sprayed to the washing space 21 by the spray part, into the sump 41.

That is, the washing water, which is sprayed toward the dishes by the spray part, may fall downward to a lower side of the washing space 21 and be recovered into the sump 41 through the sump cover 42.

The washing pump 45 is provided at a lateral or lower side of the sump 41 and serves to pressurize the washing water and supply the washing water to the spray part.

One end of the washing pump 45 may be connected to the sump 41, and the other end of the washing pump 45 may be connected to the supply channel 46. The washing pump 45 may include an impeller 451, a motor 453, and the like. When electric power is supplied to the motor 453, the impeller 451 may rotate, and the washing water in the sump 41 may be pressurized and then supplied to the spray part via the supply channel 46.

Although not illustrated, a washing water heater may be provided at one side of the washing pump 45 and serve to heat the supplied washing water during a washing operation or a drying/rinsing operation.

Meanwhile, the supply channel 46 may serve to selectively supply the spray part with the washing water supplied from the washing pump 45.

For example, the supply channel 46 may include a first supply channel 461 connected to a lower spray arm 61, and a second supply channel 463 connected to an upper spray arm 62 and a top nozzle 63. A supply channel switching valve 465 may be provided in the supply channel 46 and selectively open or close the supply channels 461 and 463.

In this case, the supply channel switching valve 465 may be controlled to sequentially or simultaneously open the supply channels 461 and 463.

Meanwhile, the spray part is configured to supply the washing water to the dishes and the like accommodated in the accommodation part 50.

More specifically, the spray part may include the lower spray arm 61 positioned at a lower side of the tub 20 and configured to spray the washing water to a lower rack 51, the upper spray arm 62 positioned between the lower rack 51 and an upper rack 52 and configured to spray the washing water to the lower rack 51 and the upper rack 52, and the top nozzle 63 positioned at an upper side of the tub 20 and configured to spray the washing water to a top rack 53 or the upper rack 52.

In particular, the lower spray arm 61 and the upper spray arm 62 may be rotatably provided in the washing space 21 of the tub 20 and spray the washing water while rotating toward the dishes in the accommodation part 50.

The lower spray arm 61 may be rotatably supported above the sump cover 42 to spray the washing water toward the lower rack 51 while rotating at a position below the lower rack 51.

In addition, the upper spray arm 62 may be rotatably supported by a spray arm holder 467 to spray the washing water while rotating at a position between the lower rack 51 and the upper rack 52.

Meanwhile, although not illustrated, a means for switching a direction of the washing water sprayed from the lower spray arm 61 to an upward direction (U-direction) may be further provided on a lower surface 25 of the tub 20 to improve washing efficiency.

Because the configuration already publicly known in the art may be applied to the detailed configuration of the spray part, a description of the specific configuration of the spray part will be omitted hereinafter.

Meanwhile, the accommodation part 50 for accommodating the dishes may be provided in the washing space 21.

The accommodation part 50 may be configured to be withdrawn from the inside of the tub 20 through the opened front side of the tub 20.

FIG. 2 exemplarily illustrates an embodiment in which the accommodation part includes the lower rack 51 positioned at the lower side of the tub 20 and configured to accommodate comparatively large dishes, the upper rack 52 positioned above the lower rack 51 and configured to accommodate dishes with middle sizes, and the top rack 53 positioned at the upper side of the tub 20 and configured to accommodate dishes and the like with small sizes. As illustrated, the description will be made on the basis of the embodiment of the dishwasher 1 in which three accommodation parts 50 are provided. However, the present invention is not limited thereto.

The lower rack 51, the upper rack 52, and the top rack 53 may be configured to be withdrawn to the outside through the opened front side of the tub 20.

To this end, guide rails 54 may be provided at two opposite side walls that define an inner peripheral surface of the tub 20. For example, the guide rails 54 may include an upper rail, a lower rail, a top rail, and the like.

Wheels may be provided on a lower portion of each of the lower rack 51, the upper rack 52, and the top rack 53. A user may withdraw the lower rack 51, the upper rack 52, and the top rack 53 to the outside through the front side of the tub 20 and easily accommodate the dishes on the lower rack 51, the upper rack 52, and the top rack 53 or easily take out the completely washed dishes from the lower rack 51, the upper rack 52, and the top rack 53.

The guide rail 54 may be provided in the form of a stationary guide rail with a simple rail shape for withdrawing or loading the accommodation part 50 or a stretchable guide rail configured to guide the withdrawal and accommodation of the accommodation part 50 and increase a withdrawal distance in accordance with the withdrawal of the accommodation part 50.

Meanwhile, the door 30 serves to open or close the opened front side of the tub 20.

Typically, a hinge part (not illustrated) is provided below the opened front side of the tub 20 to open or close the door 30, and the door 30 is opened while rotating about the hinge part as a rotation axis.

In this case, a handle 31 used to open the door 30 may be provided on an outer surface of the door 30, and a control panel 32 configured to control the dishwasher 1 may be provided on the outer surface of the door 30.

As illustrated, the control panel 32 may have a button part 34 including a display 33 configured to visually display information on a current operating state or the like of the dishwasher, a selection button to which the user's selection manipulation is inputted, and a power button to which the user's manipulation for turning on or off the power of the dishwasher is inputted.

Meanwhile, an inner surface of the door 30 may define one surface of the tub 20 when the door 30 is closed, and the inner surface of the door 30 may define a seating surface on which the lower rack 51 of the accommodation part 50 may be supported when the door 30 is fully opened.

To this end, when the door 30 is fully opened, the inner surface of the door 30 may be formed in a horizontal plane state in a direction identical to a direction in which the guide rail 54 configured to guide the lower rack 51 extends.

Meanwhile, a detergent supply device 200 may be further provided on the inner surface of the door 30 and automatically supply a detergent into the tub 20.

Meanwhile, a moisture sorption drying device 80 may be provided in an installation space of a base 90 at the lower side of the tub 20. The moisture sorption drying device 80 may absorb water vapor contained in air discharged from the tub 20 and then resupply the air into the tub 20 during the drying operation.

As illustrated, the moisture sorption drying device 80 may include a suction duct 81 configured to suck air discharged from the tub 20, a blowing part 82 configured to generate an airflow, a heater part 83 configured to heat the air sucked from the tub 20, and a moisture absorbent 85 configured to absorb water vapor contained in the air.

As described below, an air supply hole 254 may be provided in the lower surface 25 of the tub 20 so that the air from which water vapor is removed by the moisture sorption drying device 80 may be introduced into the tub 20.

In addition, an air suction hole 271, through which humid air is discharged from the tub 20, may be provided in one side surface, e.g., a right surface 27 of the tub 20, and a grille cap 8113 may be fixed to the air suction hole 271 and coupled to an inlet of the suction duct 81.

A detailed configuration of the moisture sorption drying device 80 will be described below with reference to FIG. 4 below.

Detailed Configuration of Moisture Sorption drying Device

Hereinafter, a detailed configuration of the moisture sorption drying device 80 according to the embodiment of the present invention will be described with reference to FIGS. 4 to 11.

Figure 4:
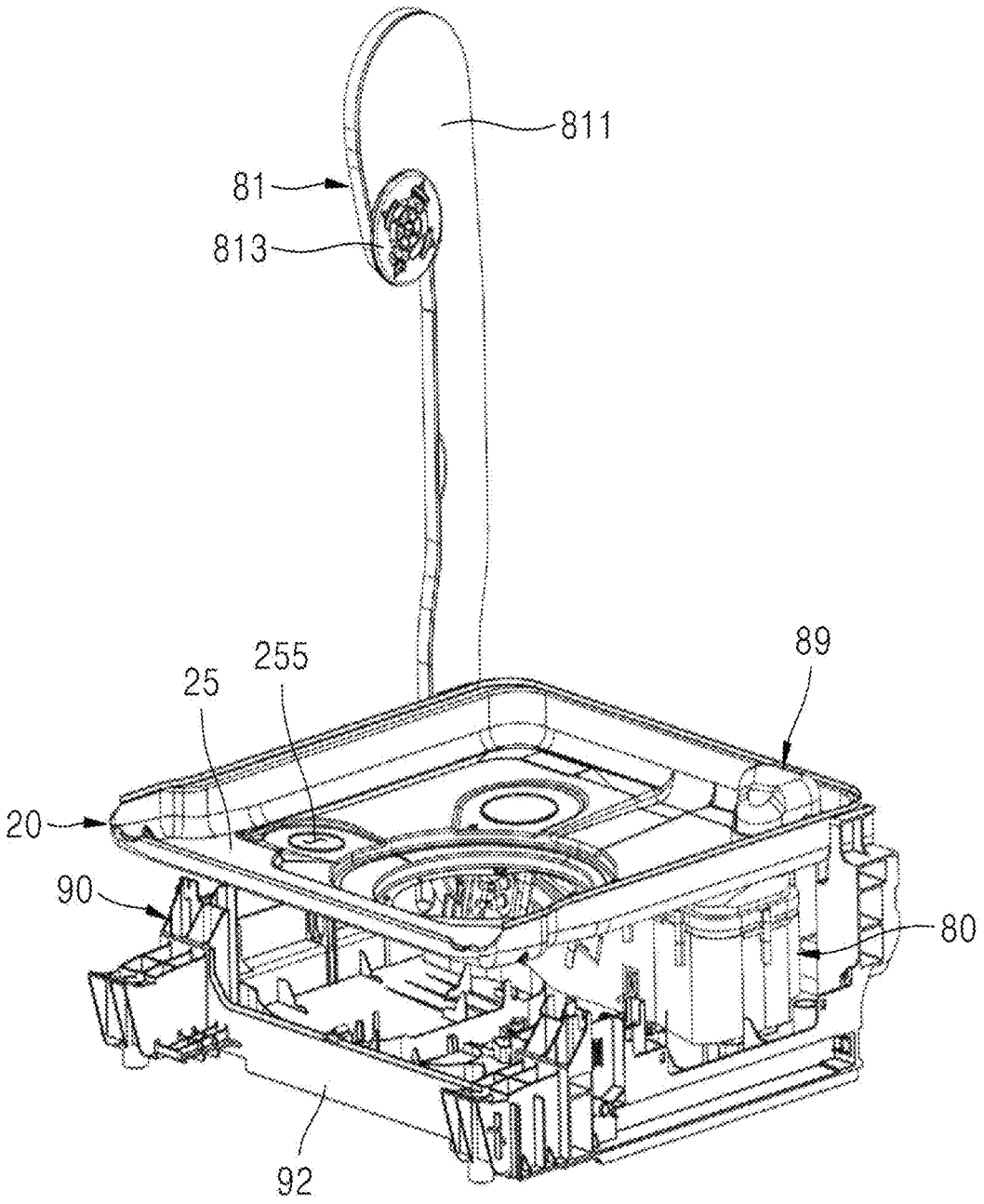
FIG. 4 is a front perspective view illustrating a state in which a moisture sorption drying device of the dishwasher according to the embodiment of the present invention is accommodated in a base.
Figure 5:
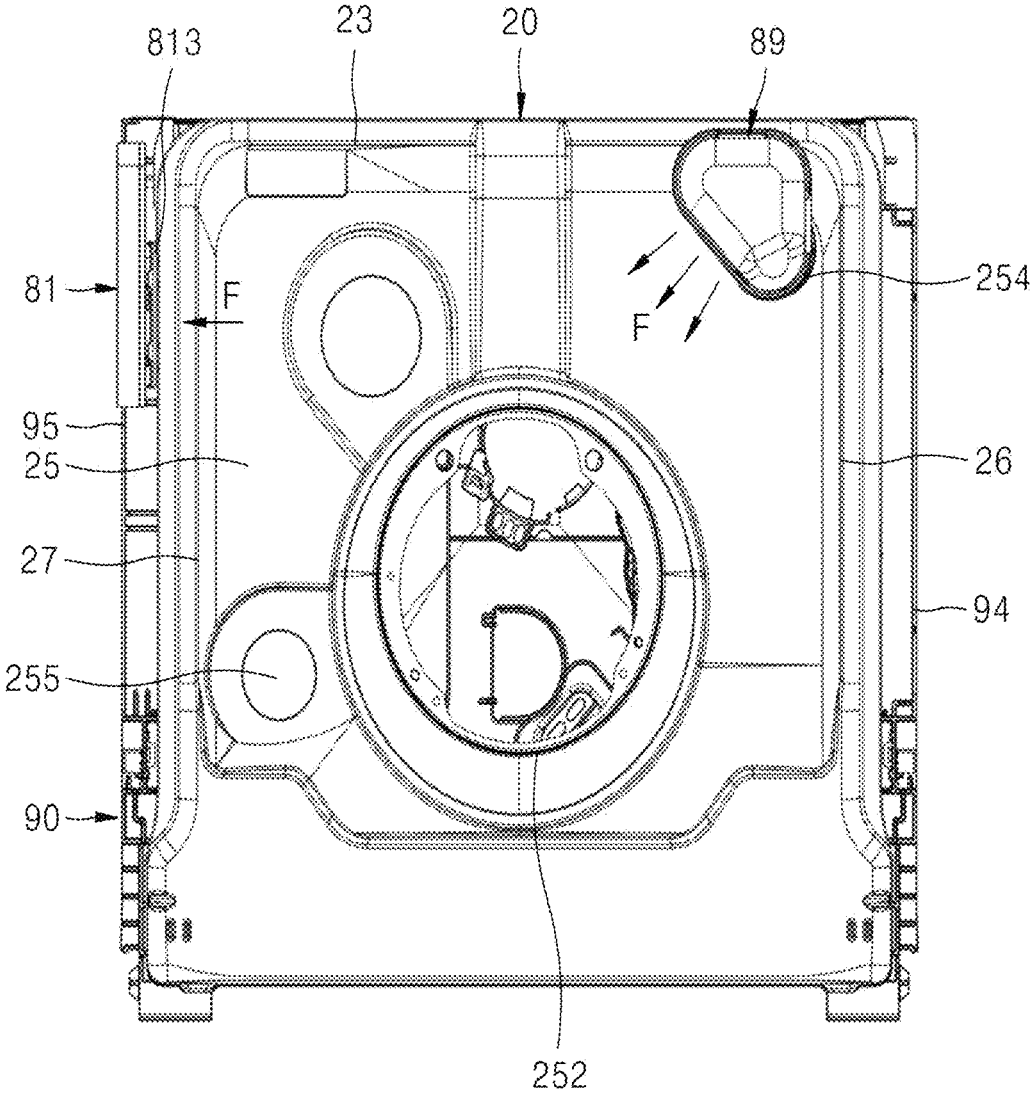
FIG. 5 is a top plan view of FIG. 4.
Figure 6:
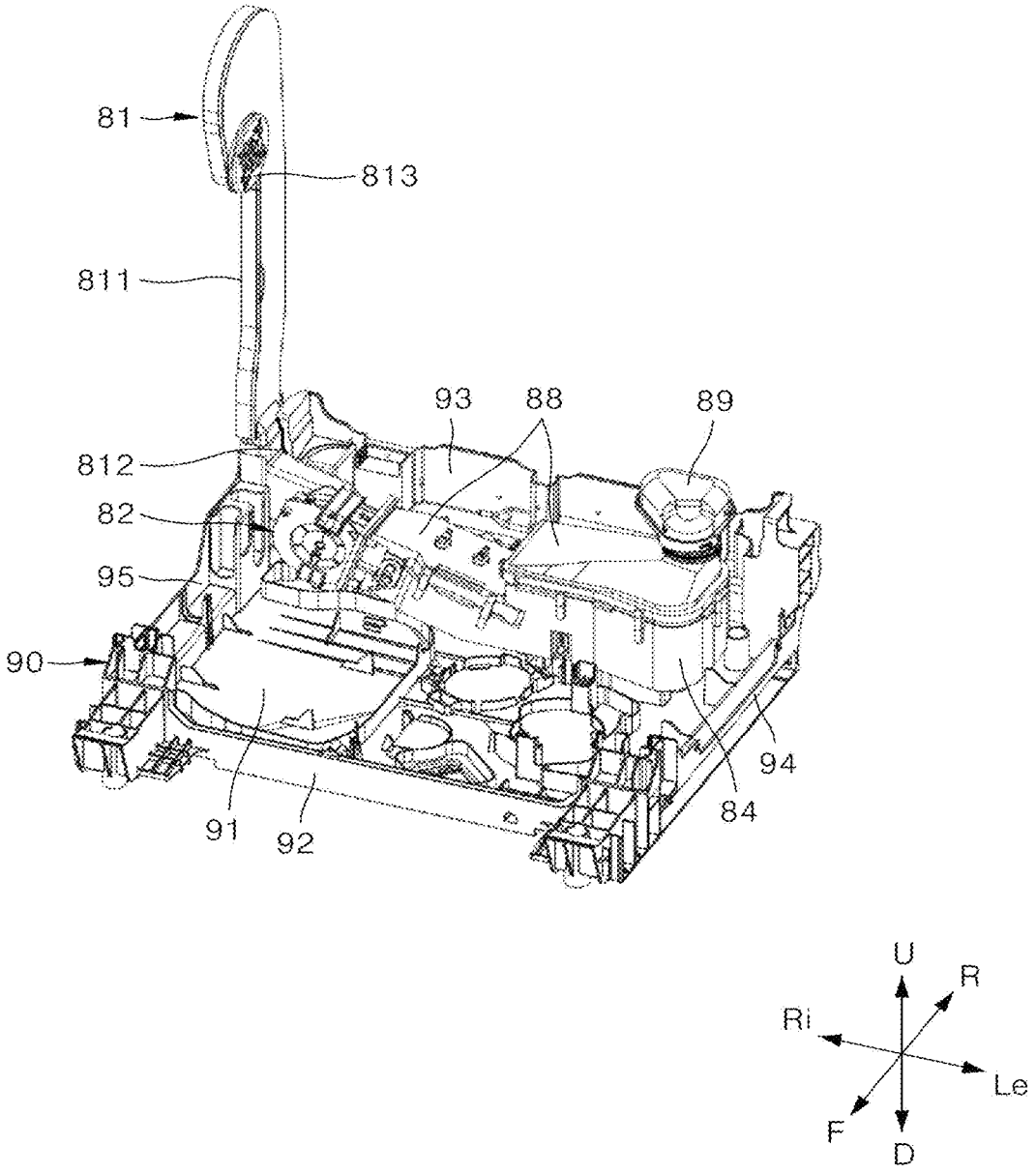
FIG. 6 is a front perspective view illustrating a state in which a tub in FIG. 4 is removed.

First, as illustrated in FIGS. 4 to 6, the moisture sorption drying device 80 may be disposed such that the remaining parts, which exclude a main duct 811 of the suction duct 81 and a discharge guide 89, are accommodated in an installation space between the base 90 and the lower surface 25 of the tub 20 and supported by a bottom surface 91 of the base 90.

For example, the blowing part 82, the heater part 83, and a housing 84 of the moisture sorption drying device 80 may be disposed at positions adjacent to a rear surface 93 of the base 90 and arranged in parallel with the rear surface 93 of the base 90. More specifically, as described below, the blowing part 82, the heater part 83, and the housing 84 may be disposed in the installation space of the base 90 so as to be arranged between the sump 41 and the rear surface 93 of the base 90 in a leftward/rightward direction.

The arrangement position of the moisture sorption drying device 80 may be selected in consideration of the properties of the heater part 83 of the moisture sorption drying device 80 that generates high-temperature heat with approximately 200° C. or more in a moisture absorbent drying mode or a moisture absorbent regenerating mode. That is, a position, which avoids electrical components relatively greatly affected by high-temperature heat, may be selected.

As described above, the blowing part 82, the heater part 83, and the housing 84 of the moisture sorption drying device 80 are disposed adjacent to the rear surface 93 of the base 90 and arranged in parallel with the rear surface 93 of the base 90 in a long line, such that the moisture sorption drying device 80 may additionally serve as a counterweight for preventing the dishwasher 1 from being inclined forward, i.e., falling over forward by a load applied to the door 30 when the door 30 is in a fully opened state. Because the moisture sorption drying device 80 serves as a counterweight as described below, a weight balance 99, which is mounted to prevent the dishwasher 1 from falling over, may be miniaturized and lightweight.

In addition, as illustrated in FIGS. 4 to 6, the arrangement position may be selected based on the position of the air supply hole 254 formed in the lower surface 25 of the tub 20. The air supply hole 254, through which dry air is discharged, may be formed at a corner of the lower surface 25 of the tub 20 that is adjacent to a rear surface 23 and a left surface 26 in consideration of user's safety so that the air supply hole 254 is distinguished from a water softener communication hole 255 disposed adjacent to the front side of the tub 20. Therefore, as illustrated, the air supply hole 254 may be formed at a position closer to the rear surface 23 of the tub 20 than the sump 41.

The air, which is supplied through the air supply hole 254, may be uniformly distributed to the washing space 21 of the tub 20 through the discharge guide 89 disposed in a state of being exposed to the washing space 21.

In particular, the housing 84 of the moisture sorption drying device 80, which accommodates the moisture absorbent 85, may be disposed adjacent to a lower side of the air supply hole 254 so that the air with absorbed moisture may be effectively supplied through the air supply hole 254 formed at this position.

However, the arrangement position of the moisture sorption drying device 80 is provided for illustrative purposes only. On the contrary, the moisture sorption drying device 80 may be disposed at a position adjacent to a left surface 94, a right surface 95, or a front surface 92 instead of the rear surface 93 of the base 90. Hereinafter, the description will be made on the basis of an embodiment in which the moisture sorption drying device 80 is disposed adjacent to the rear surface 93 of the base 90 and arranged approximately in parallel with the rear surface 93 of the base 90. However, the present invention is not limited thereto.

Meanwhile, as illustrated in FIGS. 4 to 6, the blowing part 82, the heater part 83, and the housing 84 of the moisture sorption drying device 80 may be disposed adjacent to the rear surface 93 of the base 90 and arranged in parallel with the rear surface 93. In case that the air supply hole 254 is formed at the corner of the lower surface 25 of the tub 20 that is adjacent to the rear surface and the left surface. The air suction hole 271, through which humid air is discharged from the tub 20, may be formed at an edge of the right surface 27 of the tub 20 at which the right surface 27 and the rear surface 23 meet together. The air suction hole 271 may be formed at a position adjacent to an upper surface 24 of the tub 20. In addition, like the air supply hole 254, the air suction hole 271 may be formed at a position closer to the rear surface 23 of the tub 20 than the sump 41 based on the forward/rearward direction.

The position of the air suction hole 271 may be selected as a position maximally distant from the air supply hole 254 formed in the lower surface 25 of the tub 20.

Because the air suction hole 271 is disposed at the position maximally distant from the air supply hole 254 and the discharge guide 89 as described above, it is possible to remarkably reduce a likelihood that the air passing through the air supply hole 254 and the discharge guide 89 is introduced directly back into the air suction hole without passing over the washing target.

In addition, as described below, the air suction hole 271 may be disposed at a position higher in the upward/downward direction than an upper rail 542 constituting the guide rail 54. For example, the air suction hole 271 may be disposed between a top rail 543 and the upper rail 542 based on the upward/downward direction.

Therefore, because the air suction hole 271 may be formed at the position higher in the upward/downward direction than the upper rack 52 mounted on the upper rail 542 and configured to move while being guided by the upper rail 542, an airflow F in the washing space 21 may be guided so that the air uniformly passes through the lower rack 51 and the upper rack 52 and then is introduced into the air suction hole 271.

In addition, the air suction hole 271, together with the main duct 811 to be described below, may be formed rearward of the water jacket 110 that stores the washing water to be supplied to the sump 41 that stores the washing water.

In this case, as described below, a tub hole 118 may be formed in the water jacket 110 and allow the internal space to communicate with the washing space 21 of the tub 20, and a water jacket communication hole 272 may be provided in the right surface 27 of the tub 20 while corresponding to the tub hole 118.

The air suction hole 271 may be formed at a position, which may avoid the water jacket 110, and formed above the water jacket communication hole 272.

A grille cap 118*a* similar in shape to a grille cap 813 of the air suction hole 271 may be coupled to the tub hole 118 to minimize the inflow of the washing water and prevent the inflow of foreign substances.

Meanwhile, the grille cap 813 may be coupled to the air suction hole 271. The grille cap 813 may minimize a degree to which the washing water and foreign substances, which scatter in the tub 20, are introduced into the suction duct 81.

The grille cap 813 may pass through the air suction hole 271 and be coupled to an inlet 811*a* of the main duct 811 that constitutes the suction duct 81.

FIGS. 7 to 11 illustrate a detailed configuration of the moisture sorption drying device 80.

As illustrated, the moisture sorption drying device 80 may include the blowing part 82 configured to generate the airflow F of the air sucked from the tub 20 and to be supplied to the tub 20, the heater part 83 having a heater 831 configured to heat the air to be supplied to the moisture absorbent 85, the plurality of moisture absorbents 85 disposed at a downstream side of the blowing part 82 and the heater part 83 in a flow direction of the air and configured to absorb moisture contained in the air, the housing 84 configured to define therein a heater accommodation space S1 for accommodating the heater part 83 and a moisture absorbent accommodation space S3 for accommodating the moisture absorbent 85, and the suction duct 81 configured to connect the air suction hole of the tub 20 and the blowing part 82.

Based on the flow direction of the airflow F, the blowing part 82 is disposed at an upstream side of the heater part 83 and the moisture absorbent 85 and disposed at a downstream side of the suction duct 81. The blowing part 82 serves to suck the air from the tub 20 and generate the airflow F of the air so that the sucked air may pass through the moisture absorbent 85.

An assembly may be formed in which a blowing fan (not illustrated) and a blowing motor (not illustrated) configured to generate rotational driving power for the blowing fan are modularized together and accommodated in a fan housing 821.

The fan housing 821 may be fixed to a main housing 841, which will be described below, by means of a connecting bracket 822.

Meanwhile, a sub-duct 812, which constitutes the suction duct 81, may be coupled and fastened to the other side surface of the fan housing 821 in which the suction port is formed.

For example, a Sirocco fan is appropriate in consideration of a positional constraint and a spatial constraint related to the installation of the blowing fan. However, the type of blowing fan applied to the moisture sorption drying device 80 is not limited.

In case that the Sirocco fan is applied in the illustrated embodiment, the air, which is guided by the sub-duct 812 of the suction duct 81, may be introduced from the other side surface, i.e., the rear surface of the fan housing 821 in a direction parallel to a rotation axis from a center of the Sirocco fan, the air may be accelerated radially outward, and then the air may be discharged through the discharge port.

The air, which is accelerated and discharged, may generate the airflow F, pass through an introduction port IN1 of a heater accommodation portion 8411 of the main housing 841, and then be introduced into a heater housing 832 to be described below. In addition, condensate water droplets produced in the main duct 811 and the sub-duct 812 may be introduced into the fan housing 821, pass through a discharge port 8211, and be introduced into the introduction port IN1 of the heater accommodation portion 8411.

The heater part 83 is disposed between the blowing part 82 and the moisture absorbent 85 based on the flow direction of the airflow F and serves to heat the airflow F of the air to dry and regenerate the moisture absorbent 85 in the moisture absorbent drying mode or the moisture absorbent regenerating mode.

In case that the moisture sorption drying device 80 generates a high-temperature airflow F in the moisture absorbent drying mode, electric power may be supplied to the heater 831, such that the heater 831 may heat the airflow F. In case that the moisture sorption drying device 80 generates a low-temperature airflow F in a moisture absorption mode, a supply of electric power to the heater 831 may be cut off, such that the operation of the heater 831 may be stopped.

In this case, the operation of the blowing motor may be maintained in case that the low-temperature airflow F is generated in the moisture absorption mode.

For example, a tubular sheath heater may be selected, and the sheath heater may have a comparatively simple structure and excellent heat generation efficiency and be advantageous in preventing an electric leakage caused by the washing water introduced from the tub 20. However, the type of the heater 831 provided in the moisture sorption drying device 80 according to the embodiment of the present invention is not limited.

In order to improve heat exchange efficiency, a heater main body 8311 of the heater 831, which is a sheath heater, is exposed directly to the airflow F of the air in an air passageway in the heater housing 832 and has a three-dimensional shape bent multiple times to ensure a maximum heat transfer area.

Figure 11:
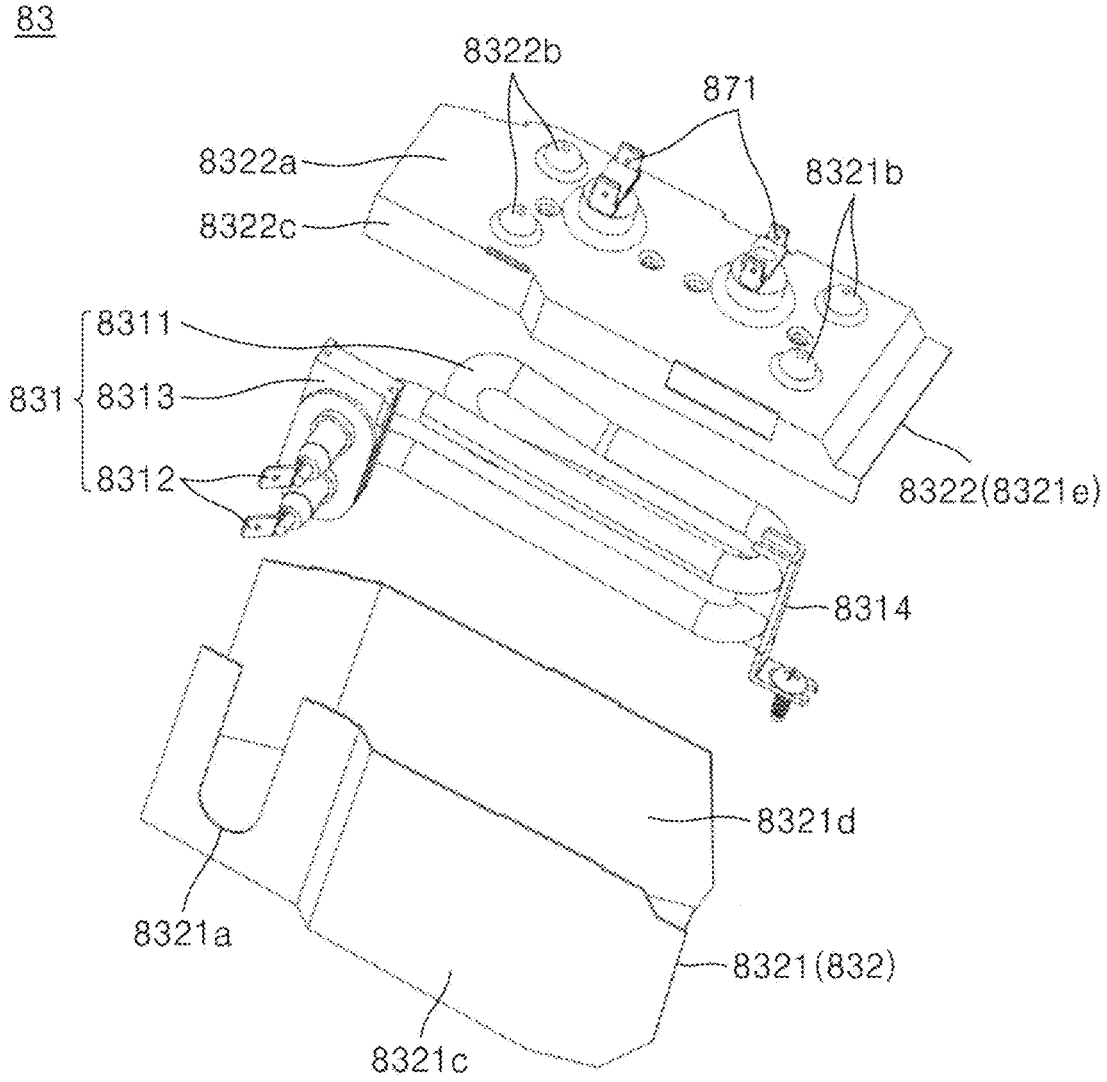
FIG. 11 is an exploded perspective view of a heating part illustrated in FIG. 9.
Figure 12:
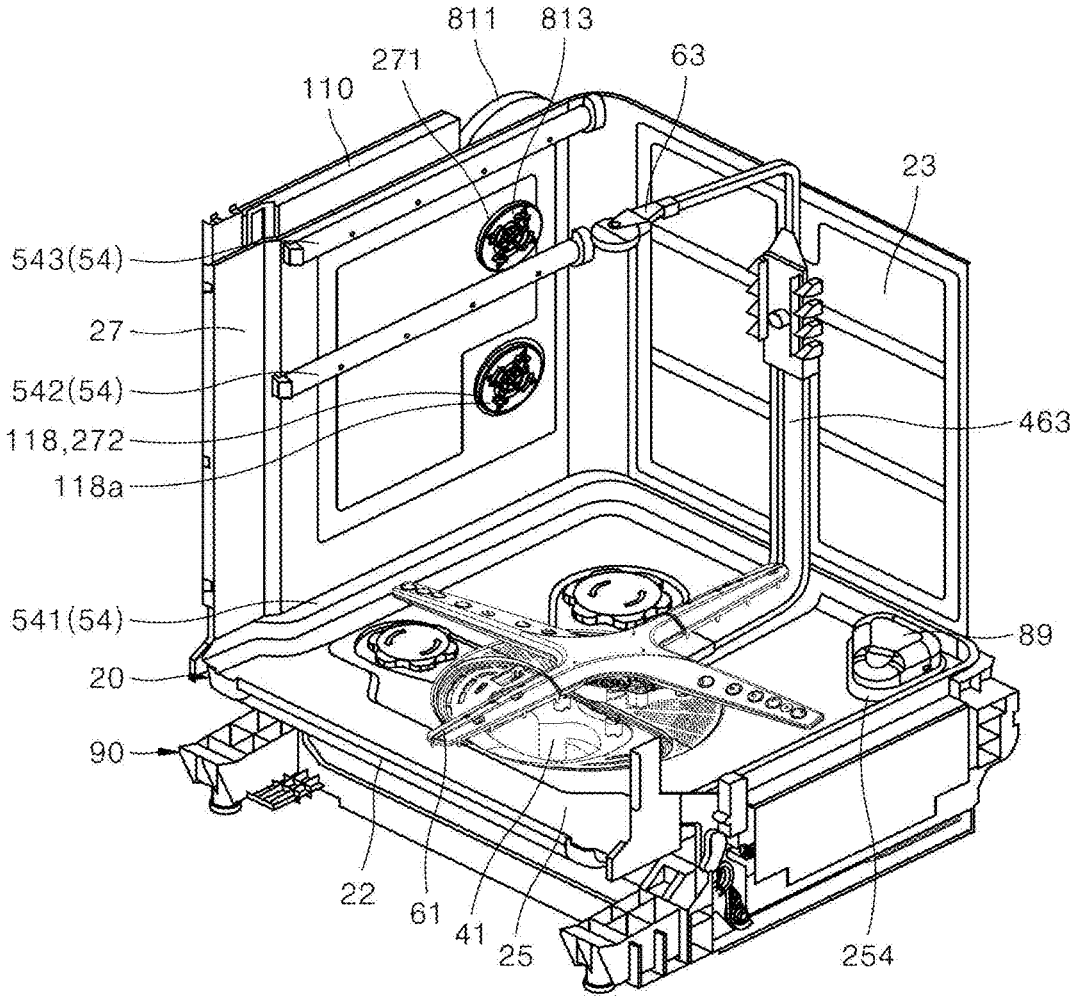
FIG. 12 is a front perspective view for explaining a relative arrangement position between the moisture sorption drying device and a water jacket of the dishwasher according to the embodiment of the present invention.

For example, FIG. 11 illustrates an embodiment in which the heater main body 8311 extending in a 'U' shape is bent again by 180 degrees so that the heater main body 8311 is formed in two rows. Hereinafter, the description will be made on the basis of the embodiment in the heater main body 8311 extends in two rows. However, the present invention is not limited.

The heater main body 8311 of the heater 831 may be disposed to extend between the introduction port IN1 formed at one end, i.e., a tip portion of the heater accommodation portion 8411 of the main housing 841 and a discharge port OUT1 formed at the other end, i.e., a rear end of the heater accommodation portion 8411.

In this case, the heater main body 8311 may be disposed in the heater accommodation portion 8411 in a state in which a longitudinal direction of the heater main body 8311 is arranged to be parallel to a longitudinal direction of the heater accommodation space S1 and the heater housing 832.

Therefore, the heat exchange performance and heat exchange efficiency of the heater main body 8311 may be improved in comparison with a case in which the longitudinal direction of the heater main body 8311 is arranged to intersect the longitudinal direction of the heater accommodation space S1.

In addition, the heater main body 8311 may be disposed in the heater accommodation portion 8411 of the main housing 841 so as to be closer to the discharge port OUT1 formed at the rear end of the heater accommodation portion 8411 than the introduction port IN1 formed at the tip portion of the heater accommodation portion 8411.

One end and the other end of the heater main body 8311 may extend while penetrating a front surface of the heater housing 832 and a front surface portion of the heater accommodation portion 8411 of the main housing 841.

In addition, a pair of terminals 8312 may be formed at one end and the other end of the heater main body 8311 to receive electric power.

As illustrated, the pair of terminals 8312 may be installed and fixed to the heater accommodation portion 8411 of the main housing 841 by means of a terminal fixing part 8313.

In this case, a fixing slot 8411*c*1 may be provided in a front surface portion of the heater accommodation portion 8411 so that the terminal fixing part 8313 may be fitted with the fixing slot 8411*c*1 in a sliding manner.

Slit-shaped grooves, which extend in the sliding direction, i.e., the upward/downward direction (U-direction), may be formed in two opposite surfaces of the terminal fixing part 8313, and the terminal fixing part 8313 may be fitted with the fixing slot 8411*c*1 while sliding from above to below so that an edge of the fixing slot 8411*c*1 is introduced into the slit-shaped grooves.

As described above, the tip side of the heater main body 8311 may be fixed and supported by the terminal fixing part 8313.

As illustrated in FIG. 11, a rear end side of the heater main body 8311 may be fixed and supported by a single heater bracket 8314. That is, the rear end side of the heater main body 8311 may be supported on the air passageway by means of the heater bracket 8314 in a state in which the rear end side of the heater main body 8311 is separated from the heater housing 832 and the heater accommodation portion 8411 of the main housing 841.

In consideration of the function of the heater main body 8311 that generates high-temperature heat, the heater bracket 8314 may be made of a metallic material and particularly manufactured by pressing a metal plate highly resistant to a high temperature and moisture, for example, a board made of a material such as a stainless steel.

Meanwhile, the heater housing 832 may be formed in a hollow shape with an empty space so that the air passageway in which the heater main body 8311 is disposed is formed in the heater housing 832. The air passageway in the heater housing 832 may define a first flow channel together with an air introduction space S2 formed below a moisture absorbent accommodation portion 8412.

As described above, the heater main body 8311 may be disposed in the heater housing 832 so that the longitudinal direction of the heater main body 8311 is parallel to the flow direction of the airflow F. Therefore, like the heater main body 8311, the heater housing 832 may be disposed in the heater accommodation space SI of the heater accommodation portion 8411 of the main housing 841 so that the longitudinal direction of the heater housing 832 is parallel to the flow direction of the airflow F.

In this case, the heater housing 832 may extend linearly toward the air introduction space S2 in the longitudinal direction of the heater accommodation portion 8411 while corresponding to the shape of the heater accommodation space S1.

However, a length of the heater housing 832 may be longer than a length of the heater main body 8311 so that the heater housing 832 may accommodate the entire heater main body 8311.

In this case, the tip portion of the heater housing 832, which corresponds to the upstream side based on the flow direction of the airflow F, and the rear end of the heater housing 832, which corresponds to the downstream side, may be entirely opened so that the airflow F may flow.

For example, the heater housing 832 may include a lower housing 8321 and an upper housing 8322 formed in shapes divided in the upward/downward direction (U-direction) so that the tip portion and the rear end may easily define the opened air passageway as described above.

The lower housing 8321, which constitutes the divided lower portion of the heater housing 832, defines a front surface, a rear surface, and a lower surface of the heater housing 832 based on the illustrated state.

A passing slot 8321*a* with a 'U' shape may be formed in a front surface 8321*c* of the lower housing 8321 so that a terminal 8312 of the heater main body 8311 may pass through the passing slot 8321*a* forward.

A lower surface 8321*e* of the lower housing 8321, which defines a lower-end surface of the internal air passageway, may be formed approximately in parallel with a bottom surface portion of the heater accommodation portion 8411 of the main housing 841. As described below, because the bottom surface portion of the heater accommodation portion 8411 extends in parallel with the longitudinal direction of the heater accommodation portion 8411, the lower surface 8321*e* of the lower housing 8321 may also extend in parallel with the longitudinal direction of the heater accommodation portion 8411.

Meanwhile, the lower housing 8321 provides an air passageway having a flow path area larger than a cross-sectional area of the introduction port IN1 of the heater accommodation portion 8411.

To this end, as illustrated in FIG. 11, for example, a tip portion side of the lower housing 8321 may include an expansion section having a cross-sectional area that gradually expands in the forward/rearward direction in the flow direction of the airflow F.

Because the air passageway expands as described above, a flow velocity of the airflow F may be reduced while air passes through the introduction port IN1 of the heater accommodation portion 8411, such that the efficiency of heat exchange between the heater main body 8311 and the airflow F may be improved.

Meanwhile, the upper housing 8322 is coupled to an opened upper side of the lower housing 8321 and serves to define an upper-end surface of the internal air passageway by closing the upper side of the lower housing 8321.

To this end, an upper surface 8322*a* of the upper housing 8322 may be formed to have a size corresponding to the opened upper side of the lower housing 8321. In addition, the upper surface 8322*a* of the upper housing 8322 may be formed approximately in parallel with an upper surface portion 8411*a* of the heater accommodation portion 8411 of the main housing 841 to be described below.

A tip edge of the upper surface 8322*a* of the upper housing 8322 may extend toward an upper end of the introduction port IN1 of the heater accommodation portion 8411, and a rear end edge of the upper surface 8322*a* of the upper housing 8322 may extend toward the discharge port OUT1 of the heater accommodation portion 8411.

In this case, the rear end edge of the upper surface 8322*a* of the upper housing 8322 may extend to a position of an upper end of the discharge port OUT1 of the heater accommodation portion 8411.

In addition, like the lower housing 8321, the upper surface 8322*a* of the upper housing 8322 may linearly extend from the tip edge to the lower end edge while defining a first intersection angle with respect to a bottom surface portion of the moisture absorbent accommodation portion 8412.

Therefore, an upper-end surface of the first flow channel formed in the heater housing 832 may linearly extend to the discharge port OUT1 of the heater accommodation portion 8411.

In addition, coupling surfaces 8322*c*, which are formed to be bent in the downward direction, may be formed at front and rear edges of the upper surface of the upper housing 8322.

When the upper housing 8322 and the lower housing 8321 are coupled, the coupling surfaces 8322*c* may be respectively in surface contact with the front surface 8321*c* and a rear surface 8321*d* of the lower housing 8321.

Therefore, coupling and connection strength between the lower housing 8321 and the upper housing 8322 may be improved.

Meanwhile, as illustrated in FIG. 11, thermostats 871 may be provided at an upper side of the upper surface 8322*a* of the upper housing 8322 and detect whether the heater main body 8311 is overheated while constituting a temperature detection part 87.

For example, the thermostats 871 may be provided as a pair of thermostats 871. The pair of thermostats 871 may be arranged in the longitudinal direction of the heater main body 8311 to effectively detect whether the heater main body 8311 is locally overheated.

Figure 9:
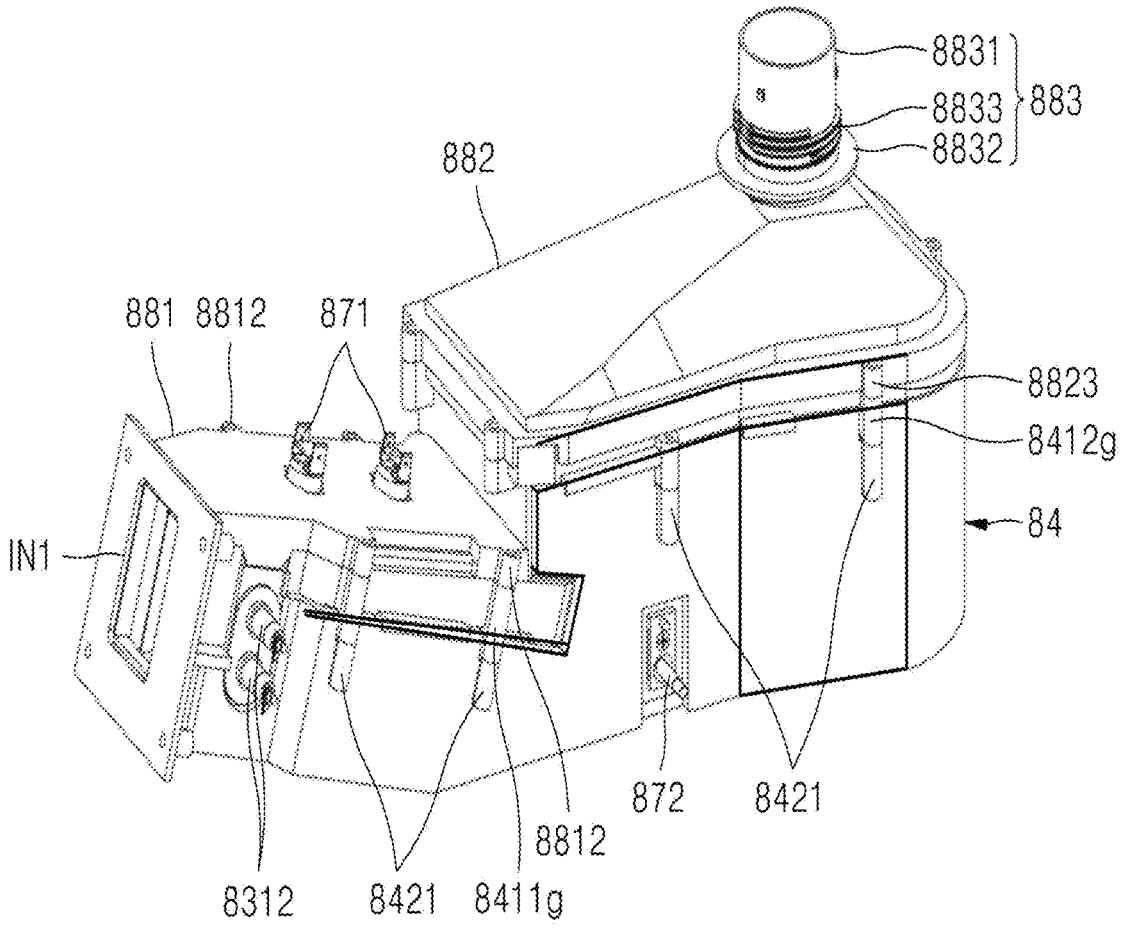
FIG. 9 is a front perspective view illustrating a state in which a heater part, a housing, and a cover of the moisture sorption drying device illustrated in FIG. 7 are coupled.
Figure 10:
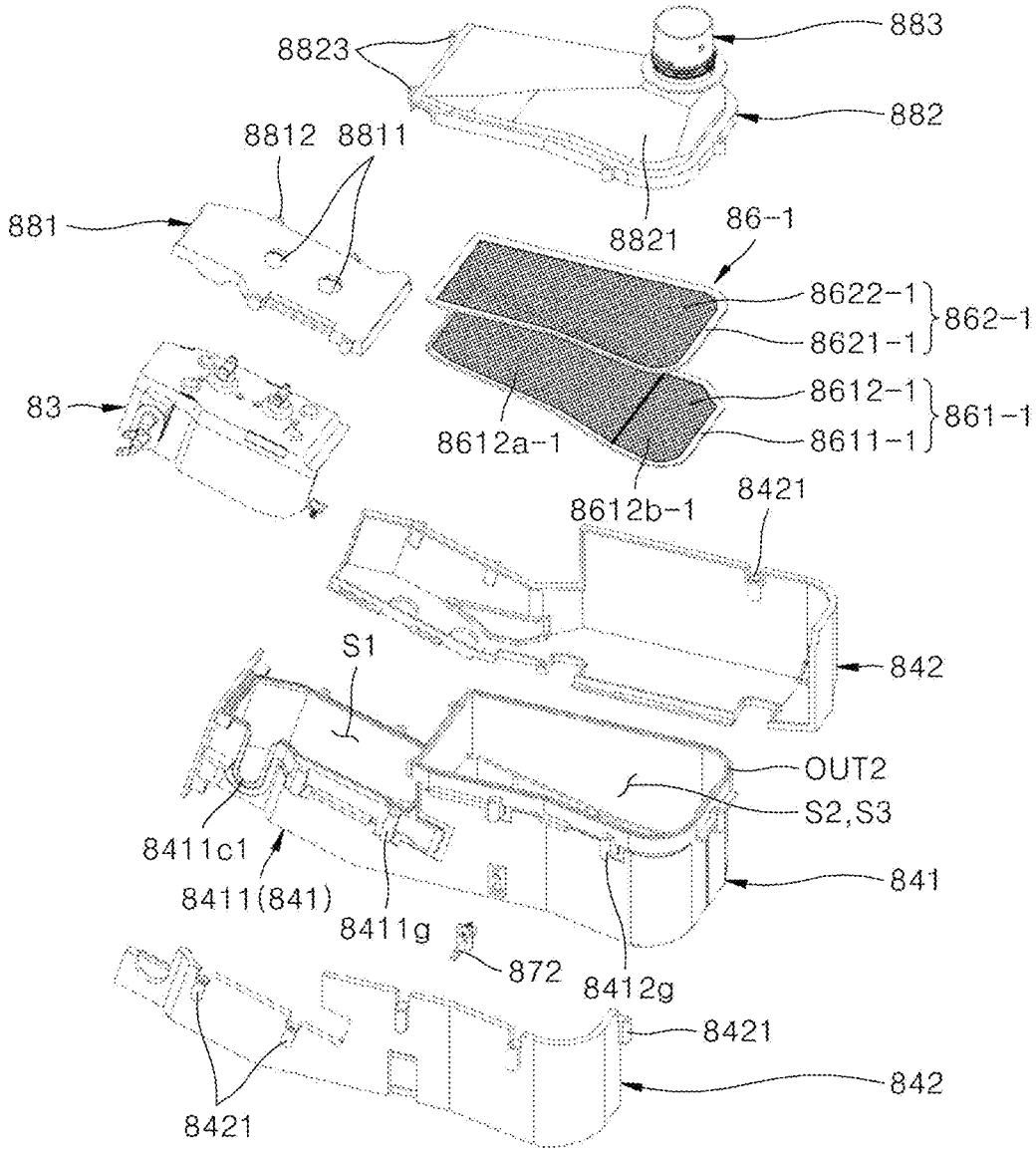
FIG. 10 is an exploded perspective view of FIG. 9.

Meanwhile, the temperature detection part 87 may further include a thermistor 872 configured to detect a temperature of the airflow F. For example, as illustrated in FIGS. 9 and 10, the thermistor 872 may penetrate a front surface portion of the moisture absorbent accommodation portion 8412 and a front surface portion of the sub-housing 842 and extend to the inside of the air introduction space S2.

An output signal of the temperature detection part 87 may be transmitted to a control unit. The control unit may receive the output signal of the temperature detection part 87 and determine whether the heater main body 8311 is overheated and a temperature of the airflow F. When the heater main body 8311 is overheated, the control unit may stop the operation of the heater main body 8311 by cutting off the supply of electric power to the heater main body 8311.

Meanwhile, a plurality of second bead forming portion 8322*b* may be formed on the upper surface 8322*a* of the upper housing 8322 and formed convexly in the upward direction.

A first cover 881, which is disposed at an upper side of the upper housing 8322, and the upper housing 8322, may be spaced apart from each other at a predetermined interval by the second bead forming portion 8321*b*, such that a separation space may be formed.

Meanwhile, in consideration of the configuration in which the heater main body 8311, which generates high-temperature heat, is disposed in the lower housing 8321 and the upper housing 8322, the lower housing 8321 and the upper housing 8322 may be formed by pressing a metal plate highly resistant to a high temperature and moisture, for example, a board having an approximately uniform thickness and made of a material such as stainless steel.

The moisture absorbent 85 serves to absorb moisture contained in the airflow of the air discharged from and sucked into the tub 20 when the moisture sorption drying device 80 operates in the moisture absorption mode. The moisture absorbent 85 serves to discharge the absorbed moisture to the airflow F when the moisture sorption drying device 80 operates in the moisture absorbent drying mode.

That is, the moisture absorbent 85 may be made of a reversibly dehydratable material to absorb moisture or discharge the absorbed moisture depending on the operating temperature range.

The applicable reversibly dehydratable material may include any one of aluminum oxide, silicon oxide, silica gel, alumina silica, and zeolite or be a composition having a combination of two or more of the materials selected from these materials.

For example, in the moisture sorption drying device 80 according to the present invention, the moisture absorbent 85 made of an alumina silica-based material including aluminum oxide and silicon oxide may be applied. The description will be made on the basis of the embodiment in which the moisture absorbent 85 made of an alumina silica-based material is applied. However, the present invention is not limited thereto.

The moisture absorbent 85, which is made of an alumina silica-based material as described above, may be provided in a particle shape having a predetermined particle diameter to ensure a maximum contact area to the airflow F of the air. In addition, in comparison with a moisture absorbent made of pure aluminum oxide or silicon oxide material, a moisture absorption action may occur within a lower temperature range, and a regeneration action may occur within a lower temperature range.

However, the airflow F of the air comes into contact with the moisture absorbent 85 and absorbs moisture or absorbs moisture discharged from the moisture absorbent 85 while passing between the plurality of moisture absorbents 85 provided in particle shapes.

Therefore, the moisture absorbent 85 may inevitably apply flow resistance against the airflow F of the air. The particle diameter of the moisture absorbent 85 may be selected to effectively form pores for minimizing the flow resistance and ensure optimal moisture absorption efficiency.

To this end, for example, the moisture absorbent 85 having a particle diameter within a range of 2 mm to 6 mm may be selected and applied.

As described below, a total amount of the moisture absorbent 85 accommodated in the moisture absorbent accommodation space S3 may be within a range of 0.8 to 2 kg even though the total amount of the moisture absorbent 85 may vary depending on shapes and sizes of first and second moisture absorbent holders 861 and 862 for defining the moisture absorbent accommodation space S3 and shapes and sizes of the moisture absorbent accommodation portion 8412 of the housing 84. In this case, the total amount of the moisture absorbent may be within particularly a range of 1 to 1.8 kg, and more particularly 1.15 kg in consideration of the dispersion and arrangement of the weight in accordance with a capacity of the washing water stored in the water jacket 110.

Meanwhile, the moisture absorbent 85 is disposed at a downstream side of the blowing part 82 and the heater part 83 based on the flow direction of the airflow F.

Specifically, the moisture absorbent 85 may be accommodated in the moisture absorbent accommodation space S3 of the main housing 841 formed at the downstream side of the blowing part 82 and the heater part 83.

The moisture absorbent accommodation space S3 may be defined by a pair of moisture absorbent holders 86 provided in the moisture absorbent accommodation portion 8412 of the main housing 841 and disposed to be spaced apart from each other in the upward/downward direction.

As illustrated in FIG. 10, for example, the pair of moisture absorbent holders 86 may include the first moisture absorbent holder 861 configured to define the lower-end surface of the moisture absorbent accommodation space S3 and divide the inside of the moisture absorbent accommodation portion into the moisture absorbent accommodation space S3 and the air introduction space S2, and the second moisture absorbent holder 862 configured to define the upper-end surface of the moisture absorbent accommodation space S3.

The first moisture absorbent holder 861 and the second moisture absorbent holder 862 may be formed in plate shapes to define the upper-end surface and the lower-end surface of the moisture absorbent accommodation space S3.

More specifically, the first moisture absorbent holder 861 may include an outer peripheral edge portion 8611 configured to maintain overall strength, and a mesh portion 8612 formed in the outer peripheral edge portion 8611 and configured to transmit air.

Likewise, the second moisture absorbent holder 862 may include an outer peripheral edge portion 8621 configured to maintain overall strength, and a mesh portion 8622 formed in the outer peripheral edge portion 8621 and configured to transmit air.

Therefore, a second flow channel, through which the airflow F of the air may pass, may be formed between the mesh portion 8612 of the first moisture absorbent holder 861 and the mesh portion 8622 of the second moisture absorbent holder 862.

In this case, in order to prevent the withdrawal of the moisture absorbent 85, the mesh portion 8612 of the first moisture absorbent holder 861 and the mesh portion 8622 of the second moisture absorbent holder 862 may have lattice sizes smaller than the particle diameter of the moisture absorbent 85.

Meanwhile, the mesh portion 8622 of the second moisture absorbent holder 862 may be disposed approximately in parallel with a bottom surface portion of the moisture absorbent accommodation portion 8412, and the mesh portion 8612 of the first moisture absorbent holder 861 may be disposed to have a predetermined intersection angle with respect to a bottom surface portion of the moisture absorbent accommodation portion 8412.

More specifically, the mesh portion 8612 of the first moisture absorbent holder 861 may include a first holding surface 8612*a* configured to define a second intersection angle with respect to the bottom surface portion of the moisture absorbent accommodation portion 8412, and a second holding surface 8612*b* configured to define a third intersection angle with respect to the bottom surface portion of the moisture absorbent accommodation portion 8412.

Meanwhile, the housing 84 of the moisture sorption drying device 80 serves to accommodate the heater part 83 and the moisture absorbent 85 and defines the first flow channel of the airflow F, which passes through the heater main body 8311, and the second flow channel of the airflow F that passes through the moisture absorbent 85.

For example, as illustrated in FIGS. 9 to 10, the housing 84 may include the main housing 841 having the heater accommodation space SI for accommodating the heater part 83 and the moisture absorbent accommodation space S3 for accommodating the moisture absorbent 85, and the sub-housing 842 coupled to an outer peripheral surface of the main housing 841.

First, the main housing 841 may include the heater accommodation portion 8411 having the heater accommodation space S1 therein, and the moisture absorbent accommodation portion 8412 having the moisture absorbent accommodation space S3 therein.

As illustrated, based on the state in which the heater accommodation portion 8411 is disposed in the base 90, the heater accommodation portion 8411 may have a hollow box shape having an entirely opened upper surface portion and having a hexahedral shape as a whole.

The heater housing 832 and the heater main body 8311 may be inserted through the opened upper side portion of the heater accommodation portion 8411.

The opened upper side portion of the heater accommodation portion 8411 may be closed by being coupled to a first cover 881 to be described below after the heater part 83 is completely disposed and assembled as described above. To this end, fastening bosses 8411*g* may be integrally provided on front and rear surface portions 8411*c* and 8411*d* of the heater accommodation portion 8411 at positions corresponding to fastening bosses 8812 of the first cover 881.

The heater accommodation space SI may be formed in the hollow heater accommodation portion 8411 and have a shape corresponding to an external shape of the heater housing 832.

Meanwhile, based on the state in which the moisture absorbent accommodation portion 8412 of the main housing 841 is disposed in the base 90, the moisture absorbent accommodation portion 8412 of the main housing 841 may have a hollow box shape having an entirely opened upper surface portion and having a hexahedral shape as a whole.

The opened upper side portion of the moisture absorbent accommodation portion 8412 may serve as a discharge port OUT2 through which the air having passed through the moisture absorbent 85 is discharged.

The opened upper side portion of the moisture absorbent accommodation portion 8412 may be closed by being coupled to a second cover 882 to be described below after the moisture absorbent holder 86 and the moisture absorbent 85 are completely disposed therein.

To this end, fastening bosses 8412*g* may be integrally provided on a front surface portion, a rear surface portion, a right surface portion, and a left surface portion of the outer peripheral surface portion of the moisture absorbent accommodation portion 8412 at positions corresponding to fastening bosses 8823 of the second cover 882.

Meanwhile, the sub-housing 842 is coupled to the main housing 841 while having a shape at least partially surrounding an outer surface of the main housing 841 and serves to thermally insulate the internal space of the main housing 841 from the outside.

As illustrated, the sub-housing 842 may be disposed to surround an outer peripheral surface and a bottom surface portion of the main housing 841 from the outside.

In this case, clearances may be at least locally formed between the inner surface of the sub-housing 842 and the outer peripheral surface portion and the bottom surface portion of the main housing 841.

With the above-mentioned clearances, a thermally insulative air layer may be formed between the sub-housing 842 and the main housing 841, like a thermally insulative air layer between the heater housing 832 and the heater accommodation portion 8411 of the main housing 841.

As illustrated in FIG. 10, the sub-housing 842 may be provided as a segmented body segmented in the forward/rearward direction in consideration of ease of manufacturing and assembling.

Meanwhile, as described above, the opened upper side portion of the heater accommodation portion 8411 of the main housing 841 and the opened upper side portion of the moisture absorbent accommodation portion 8412 may be closed by covers 88.

For example, as illustrated, in consideration of a shape of the main housing 841, the covers 88 may include the first cover 881 coupled to the heater accommodation portion 8411, and the second cover 882 coupled to the moisture absorbent accommodation portion 8412.

The first cover 881 coupled to the heater accommodation portion 8411 may be provided in a plate shape corresponding to a shape of the upper housing 8322 of the heater housing 832.

The first cover 881 may have a pair of through-holes 8811 through which the thermostat 871 may pass.

In addition, the plurality of fastening bosses 8812 may be integrally at the outer periphery edge of the first cover 881 and configured to be fastened to the main housing 841 and the sub-housing 842. Fastening means, such as screw bolts, may extend while passing through the fastening bosses 8812 and be screw-coupled to the fastening bosses 8411*g* provided on the heater accommodation portion 8411 of the main housing 841 or fastening bosses 8421 provided on the sub-housing 842.

Similar to the thermally insulative air layer between the lower housing 8321 of the heater housing 832 and the heater accommodation portion 8411 of the main housing 841, a thermally insulative air layer may be formed between the first cover 881 and the upper housing 8322.

Meanwhile, unlike the first cover 881, the second cover 882 coupled to the moisture absorbent accommodation portion 8412 may be formed to have a three-dimensional shape similar to an inverted funnel shape.

That is, an inner surface of the second cover 882 may be configured to have an inverted funnel shape convex upward so that the air having passed through the moisture absorbent 85 and the second moisture absorbent holder 862 may converge.

Therefore, because a convergence surface 8821 convex upward is provided on the second cover 882, a predetermined separation space may be formed between the convergence surface of the second cover 882 and the second moisture absorbent holder 862 for defining the upper-end surface of the moisture absorbent accommodation space S3, and the separation space defines a discharge flow path for the air having passed through the moisture absorbent 85. The discharge flow path is continuously formed in the second flow channel formed between the pair of moisture absorbent holders 86, such that the discharge flow path may be a third flow channel.

A discharge port, through which the air having passed through the third flow channel, which is the discharge flow path, is discharged, may be provided at an uppermost end of the internal convergence surface 8821 of the second cover 882.

A lower end of a connection duct part 883, which guides the airflow F toward the lower surface 25 of the tub 20, may be integrally connected to the discharge port.

In addition, like the first cover 881, the plurality of fastening bosses 8823 may be integrally provided at the outer periphery edge of the second cover 882 and configured to be fastened to the main housing 841 and the sub-housing 842. Fastening means, such as screw bolts, may extend while passing through the fastening bosses 8823 and be screw-coupled to the fastening bosses 8412*g* provided on the moisture absorbent accommodation portion 8412 of the main housing 841 or the fastening bosses 8421 provided on the sub-housing 842.

Meanwhile, the moisture sorption drying device 80 may further include the connection duct part 883 connected to the discharge port, which is penetratively formed in the upper surface of the second cover 882, and having an air passageway therein.

As described above, the heater part 83, the blowing part 82, and the moisture absorbent 85 are disposed below the lower surface 25 of the tub 20. The connection duct part 883 serves to guide the airflow F, which is discharged from the separation space formed below the second cover 882, so that the airflow F moves toward the air supply hole 254 formed in the lower surface 25 of the tub 20.

As in the illustrated embodiment, a duct main body 8831 of the connection duct part 883 may be configured to have a shape capable of connecting the air supply hole 254 of the tub 20 and the discharge port of the heater housing 832 so as to guide the airflow F.

For example, as illustrated in FIG. 9, the duct main body 8831 of the connection duct part 883 may be configured in a cylindrical shape having a lower end fluid-communicating with the discharge port of the second cover 882, and an upper end extending in the upward direction (U-direction) and passing through the air supply hole 254.

Meanwhile, as means for improving fastening efficiency and preventing water leakage, a ring-shaped flange surface 8832 and an external thread portion 8833 may be integrally provided on an outer peripheral surface of the duct main body 8831.

An upper end of the duct main body 8831 may penetrate the lower surface 25 of the tub 20 and extend in the upward direction (U-direction). The upper end of the duct main body 8831 and the external thread portion 8833 may at least partially pass through the lower surface 25 of the tub 20 and protrude toward the inside of the tub 20.

A fastening nut (not illustrated) may be coupled to the external thread portion 8833 disposed to pass through the inside of the tub 20.

Meanwhile, the discharge guide 89 may be coupled to the upper end of the duct main body 8831 and switch a discharge direction of the airflow F supplied through the connection duct part 883.

With the discharge guide 89, a part of the airflow F may be switched to propagate toward the lower surface 25 of the tub 20, and another part of the airflow F may be switched to propagate toward the upper surface 24 of the tub 20.

Meanwhile, the moisture sorption drying device 80 may further include the suction duct 81 having a tip portion connected to an air suction hole of the tub 20, and a rear end connected to the blowing part 82 and configured to serve to guide the airflow F of the air, which is discharged from the tub 20 through the air supply hole 254, to the moisture absorbent 85 through the blowing part 82 and the heater part 83.

Figure 7:
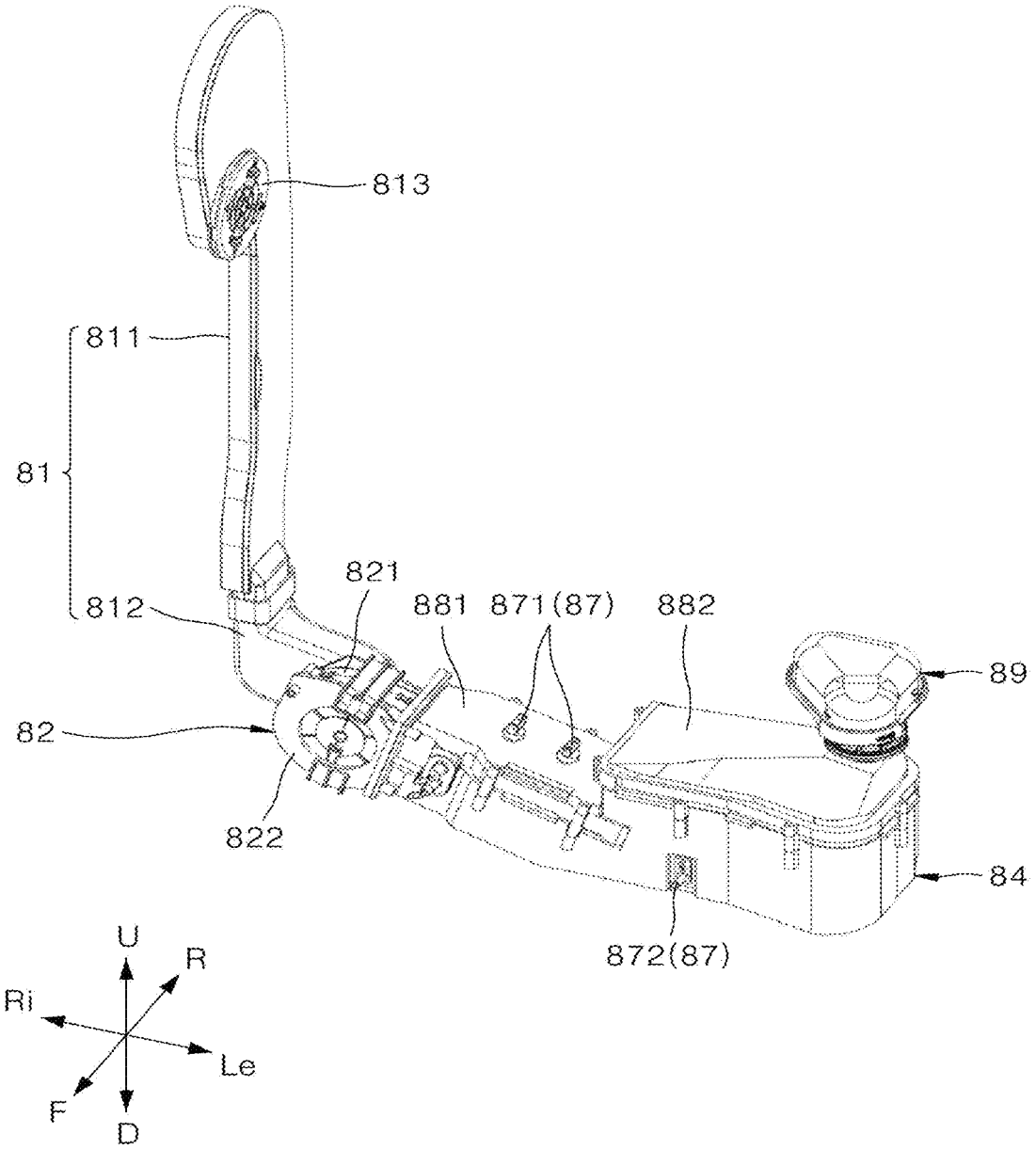
FIG. 7 is a front perspective view of the moisture sorption drying device of the dishwasher according to the embodiment of the present invention.
Figure 8:
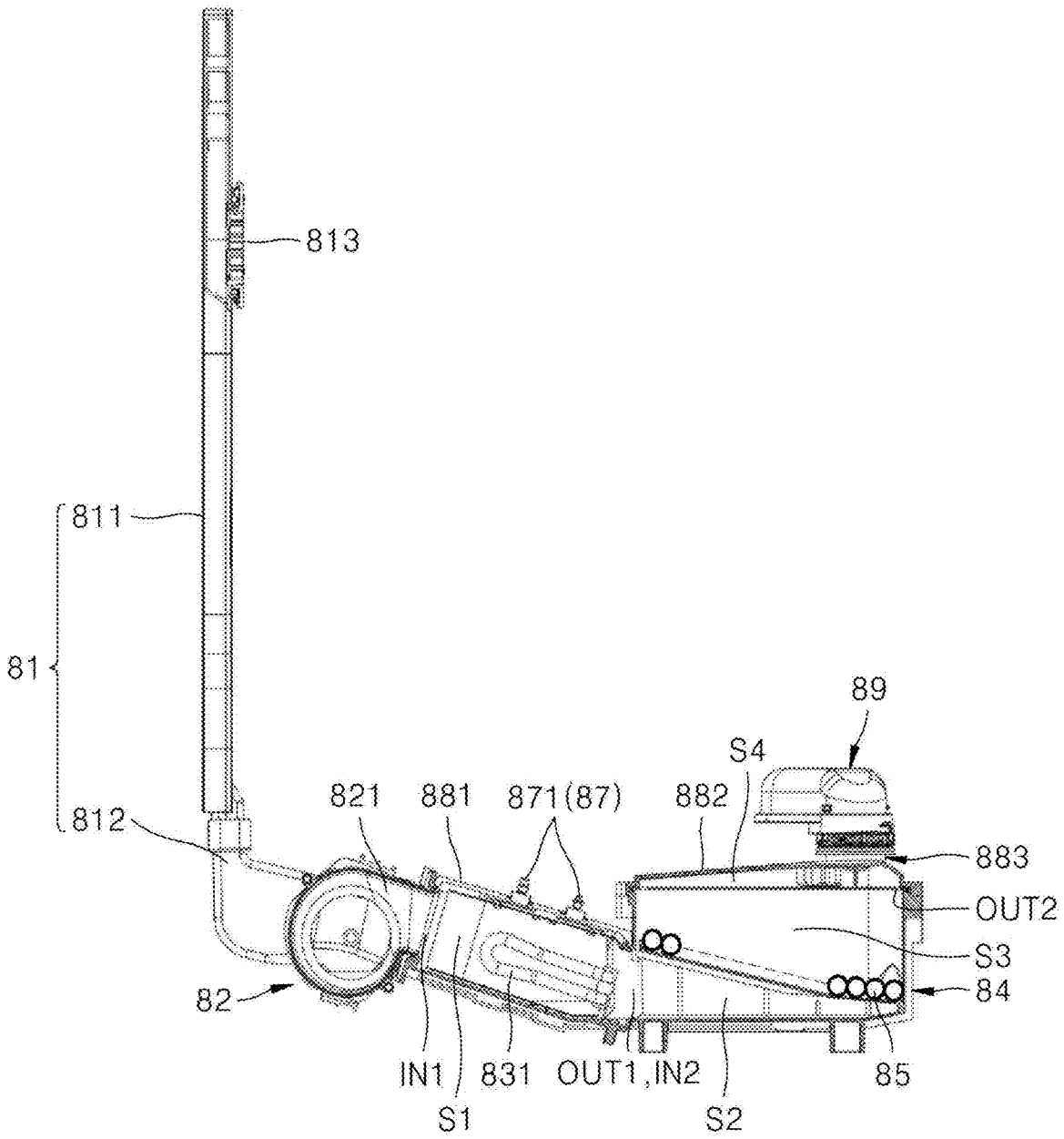
FIG. 8 is a cross-sectional view of the moisture sorption drying device illustrated in FIG. 7.

More specifically, as illustrated in FIGS. 7 to 8, the suction duct 81 may include the main duct 811 extending in the upward/downward direction and disposed outside the right surface of the tub 20, and the sub-duct 812 provided between the rear end of the main duct 811 and the blowing part 82 and disposed below the lower surface 25 of the tub 20.

The main duct 811 is disposed outside the right surface of the tub 20 and tightly attached to the right surface, and the main duct 811 serves to guide the airflow F of the air, which is sucked through an air suction hole formed in the right surface of the tub 20, to a position below the lower surface 25 of the tub 20.

To this end, as illustrated, the main duct 811 may be disposed to extend linearly to be as long as possible in the upward/downward direction from the upper end to the lower end. Therefore, moisture may be maximally condensed in the main duct 811.

In addition, as illustrated in FIG. 8, an air passageway C may be formed in the main duct 811 and extend approximately vertically so that the airflow F moves in the downward direction.

As described below, the air passageway C may include a first air passageway C1 configured to guide the airflow, which is introduced from the tub 20, in the upward direction, a second air passageway C2 configured to guide the airflow, which has passed through the first air passageway C1, in the downward direction, and a third air passageway C3 disposed between the first air passageway C1 and the second air passageway C2 and configured to switch the flow direction of the airflow.

The air having passed through the air passageway C of the main duct 811 may be introduced into the blowing part 82 through the sub-duct 812 to be described below. The airflow F having passed through the blowing part 82 may be introduced into the heater accommodation space S1 of the heater accommodation portion 8411 inclined downward.

As described above, the interior of the main duct 811 may be manufactured in a hollow shape to define an air passageway through which the airflow F of the air may flow.

Figure 13:
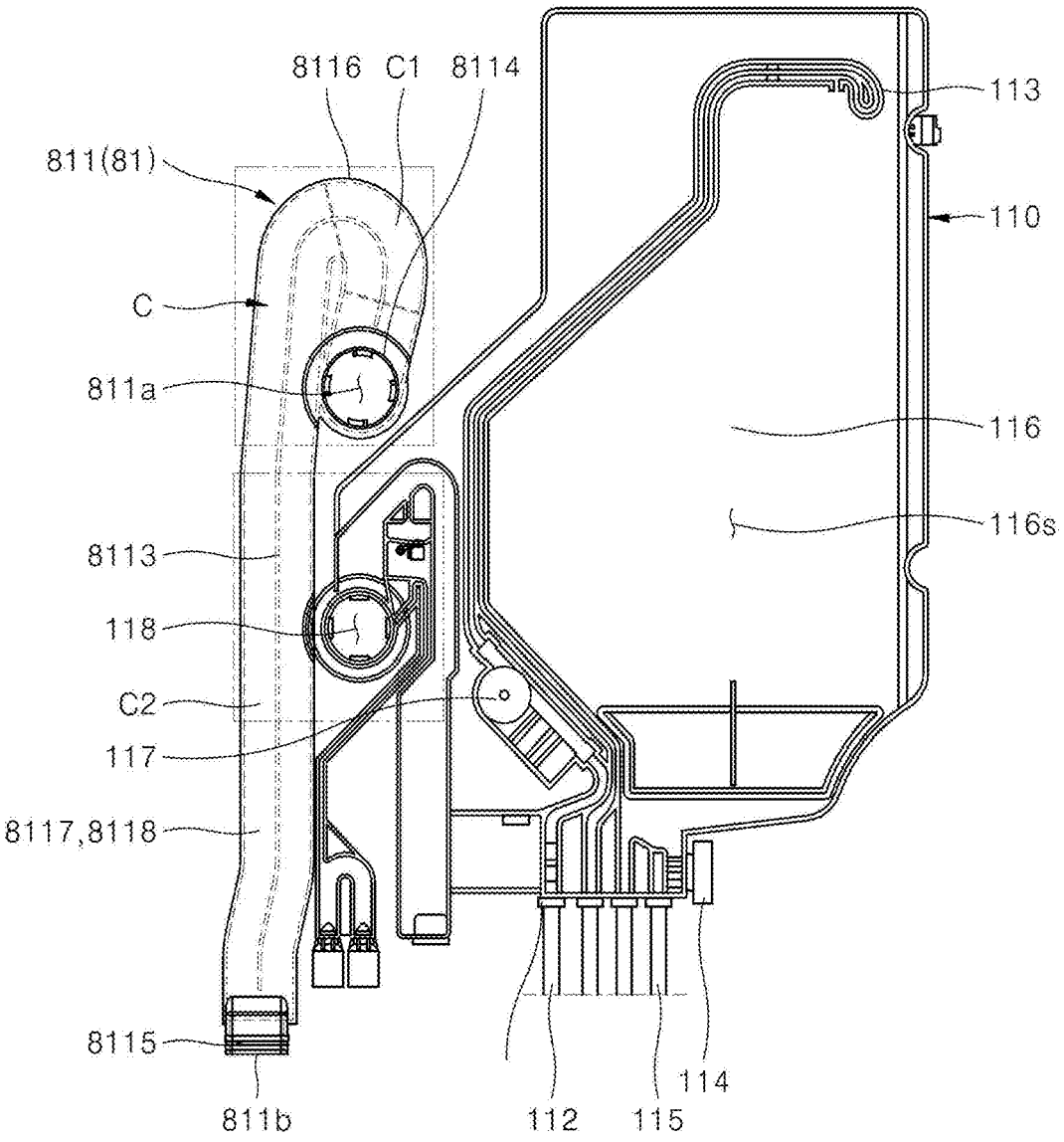
FIG. 13 is a side view of the water jacket illustrated in FIG. 12.

In order to easily implement the hollow shape and manufacturing convenience, as illustrated in FIG. 13, for example, the main duct 811 may include first and second duct bodies provided as a segmented body segmented along a vertical plane.

The first duct body may be formed in a hollow box shape opened at a left side thereof so that an inverted U-shaped air passageway may be formed therein. A hollow state is maintained in the first duct body. Therefore, a reinforcement rib 8113 may be integrally positioned on the right surface in the first duct body and extend from the right surface toward the left surface in the extension direction of the air passageway. In addition, the reinforcement rib 8113 extends from an upper end of the inlet 811*a*, which is formed in the second duct body, to an outlet 811*b* of the main duct 811 along the air passageway. Therefore, the reinforcement rib 8113 may also serve as a blocking wall for minimizing a degree to which the washing water, which is introduced from the inlet 811*a* and scatters, moves toward the outlet 811*b*. An outlet forming portion 8115 may be provided at a lower end of the first duct body and opened in the downward direction, and the outlet forming portion 8115 has the outlet 811*b* through which the airflow of the air passes. The second duct body is coupled to the opened left side of the first duct body and serves to close the air passageway formed in a first duct body 8111.

To this end, the second duct body may be provided in a plate shape corresponding to a shape of the opened left side of the first duct body.

An inlet forming portion 8114 may be provided on a second duct body 8112 and have the inlet 811*a* having shapes and sizes corresponding to the air suction port of the tub 20.

Function of Preventing Moisture Sorption Drying Device from Falling Over

Hereinafter, the function of preventing the dishwasher 1 from falling over in accordance with the arrangement position of the moisture sorption drying device 80 will be described with reference to FIGS. 12 to 16.

In case that a load, which pushes the door 30 in the downward direction, is applied at a predetermined level or higher when the door 30 is in the fully opened state as described above, the dishwasher 1 may fall over while being inclined forward based on a first front leg 96*a* and a second front leg 96*b* of the base 90.

In this case, the blowing part 82, the heater part 83, and the moisture absorbent 85 of the moisture sorption drying device 80 of the dishwasher 1 according to the embodiment of the present invention may be disposed in the installation space of the base 90 so as to be arranged in a row in the leftward/rightward direction between the sump 41 and the rear surface 93 of the base 90 based on the forward/rearward direction.

As described above, among the components of the moisture sorption drying device 80, the blowing part 82, the heater part 83, and the moisture absorbent 85 are at least arranged to be very adjacent to the rear surface of the base 90, such that the blowing part 82, the heater part 83, and the moisture absorbent 85 may be arranged at positions most spaced apart rearward from the first front leg 96*a* and the second front leg 96*b* in the installation space of the base 90 based on the horizontal direction.

Therefore, a maximally long horizontal distance from the first front leg 96*a* or the second front leg 96*b* may be ensured, such that it is possible to ensure a maximum moment of force of the moisture sorption drying device 80 that prevents the dishwasher 1 from falling over.

In addition, because the moisture sorption drying device 80 of the dishwasher 1 according to the embodiment of the present invention may include the moisture absorbent 85 with the weight at a predetermined level or higher, the weight of the moisture sorption drying device 80 may greatly increase in comparison with the related art. Therefore, the weight balance 99 disposed rearward of the moisture sorption drying device 80 may be minimized and lightweight.

For example, in the related art, the weight balance 99 with the weight of 2.5 kg or more is required to prevent the dishwasher 1 from falling over. In contrast, the moisture sorption drying device 80 with a total weight of 2.7 kg or more including the weight of 0.8 to 2 kg of the moisture absorbent 85 may be applied, such that the weight of the weight balance 99 may be reduced to a level of 1.5 to 1.7 kg less than the total weight of the moisture sorption drying device 80.

Figure 16:
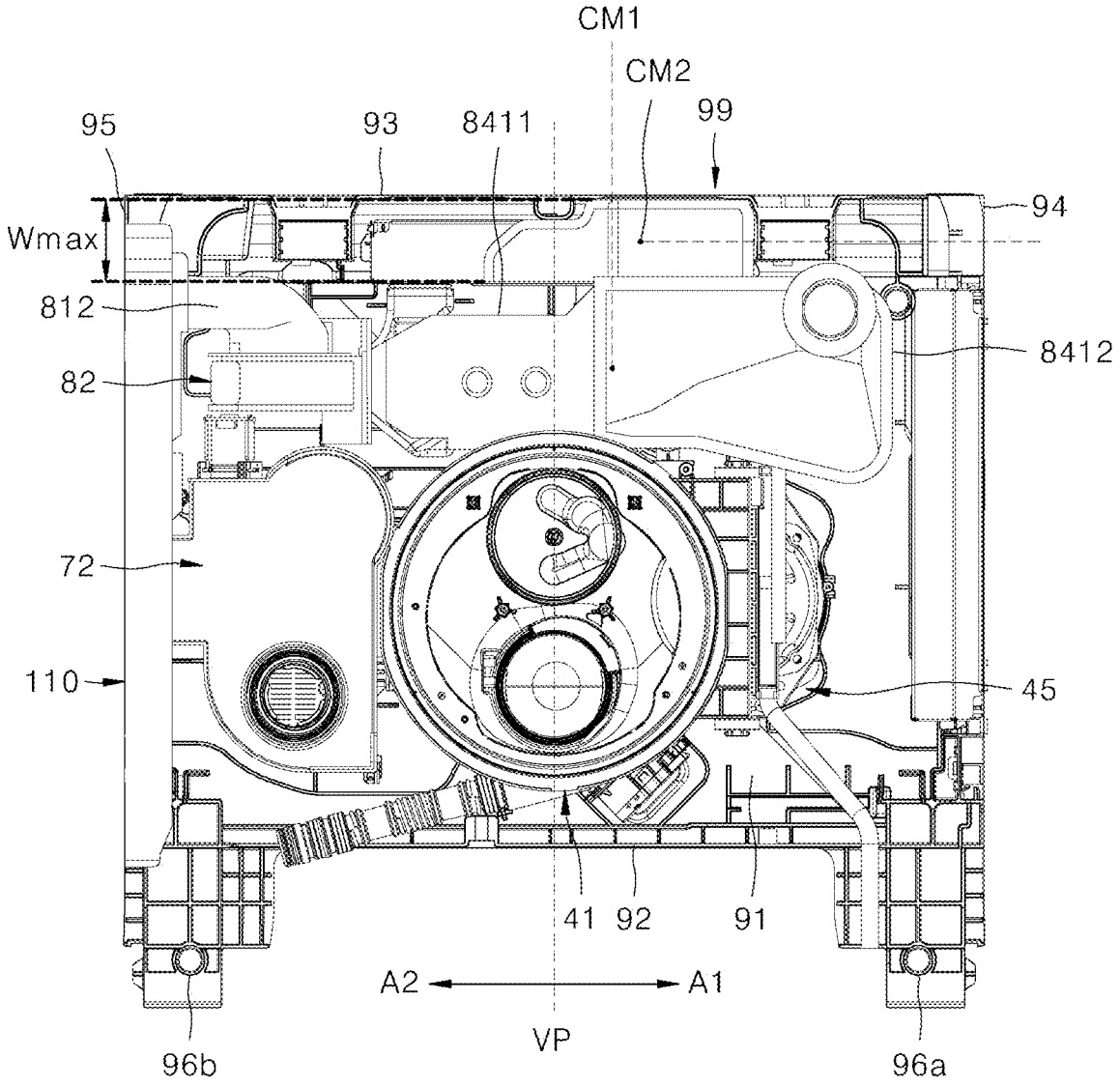
FIG. 16 is a top plan view illustrating a state in which the tub in FIG. 12 is removed.

Therefore, as illustrated in FIG. 16, a maximum width Wmax of the weight balance 99 in the forward/rearward direction may be smaller than a maximum width of the moisture absorbent accommodation portion 8412 in the forward/rearward direction. Further, an overall volume of the weight balance 99 may be maintained to be smaller than a volume of the moisture absorbent accommodation portion 8412.

Meanwhile, as illustrated in FIGS. 12 to 16, the dishwasher 1 according to the embodiment of the present invention is configured such that the water jacket 110 and the water softening device 72, which have a significantly large weight ratio, are disposed to be biased in the rightward direction based on the leftward/rightward direction toward the sump 41 disposed at an approximately central side of the installation space of the base 90. In the illustrated embodiment, the water softening device 72 is illustrated as being provided to soften the washing water. However, a water purification filter (not illustrated) may be provided instead of the water softening device 72. Hereinafter, for example, the description will be made on the basis of the configuration in which the water softening device 72 is provided.

As in the illustrated embodiment, the water jacket 110 may be disposed between the casing 10 and the tub 20.

The water jacket 110 serves to store the washing water supplied from the external water supply source and supply the stored washing water to the sump 41.

To this end, the water jacket 110 may receive the washing water from the external water supply source through a water supply flow path 112 formed at a lower end side thereof.

In this case, whether to supply the washing water through the water supply flow path 112 may be adjusted by a water supply valve 111 configured to open or close the water supply flow path 112.

Meanwhile, the water jacket 110 supplies the washing water to the sump 41 through a sump connection flow path 115 via the water softening device 72. In this case, whether to supply the washing water to the sump 41 through the sump connection flow path 115 may be adjusted by a water jacket valve 114.

In addition, the water jacket 110 may further include a supply channel 113, a storage part 116, a flow meter 117, and the tub hole 118.

The supply channel 113 defines a route through which the washing water supplied to the water jacket 110 through the water supply flow path 112 flows. The washing water supplied through the water supply flow path 112 may move to the storage part 116 through the supply channel 113.

The storage part 116 serves to store the washing water. To this end, the storage part 116 may have therein a storage space 116S with a hollow shape. In the illustrated embodiment, the washing water of a total of 1 to 2 liters may be stored in the storage space 116S. Particularly, the washing water of about 1.5 liters may be stored.

For example, the water jacket 110 may be disposed between the right surface 27 of the tub 20 and the casing 10 so as to be disposed adjacent to the main duct 811 in parallel with the main duct 811 of the moisture sorption drying device 80. The water jacket 110 may be provided in a plate shape capable of extending to the right surface 95 of the base 90 in the downward direction.

In this case, as illustrated in FIG. 13, the water jacket 110 may be disposed forward of the main duct 811 in consideration of the position at which the moisture sorption drying device 80 is disposed.

Meanwhile, the water softening device 72 may serve to soften the washing water to be supplied to the tub 20 and be manufactured in a shape capable of being accommodated in the installation space of the base 90 at the lower side of the tub 20.

Figure 14:
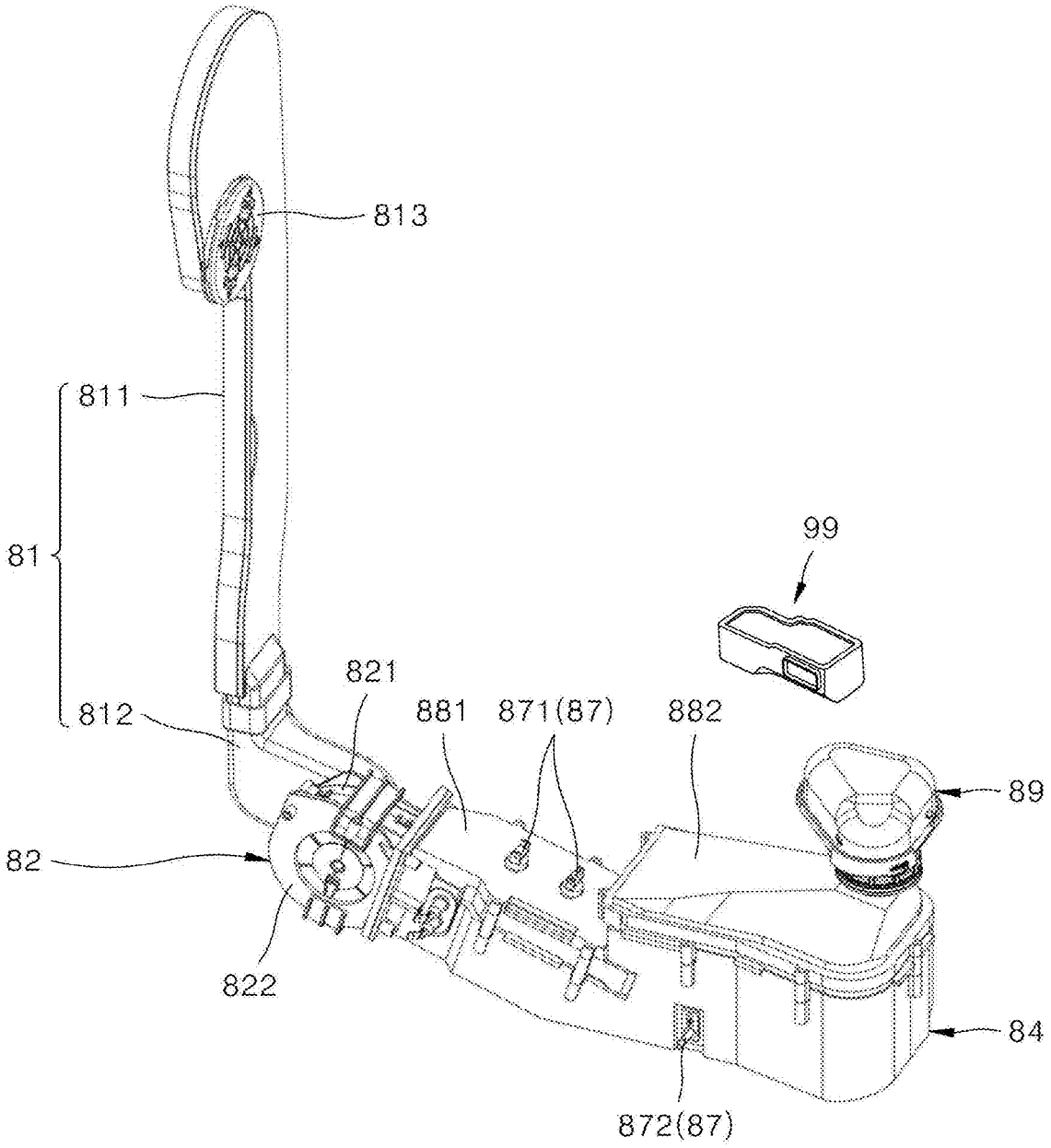
FIG. 14 is a front perspective view of a water softening device connected to the water jacket in FIG. 12.
Figure 15:
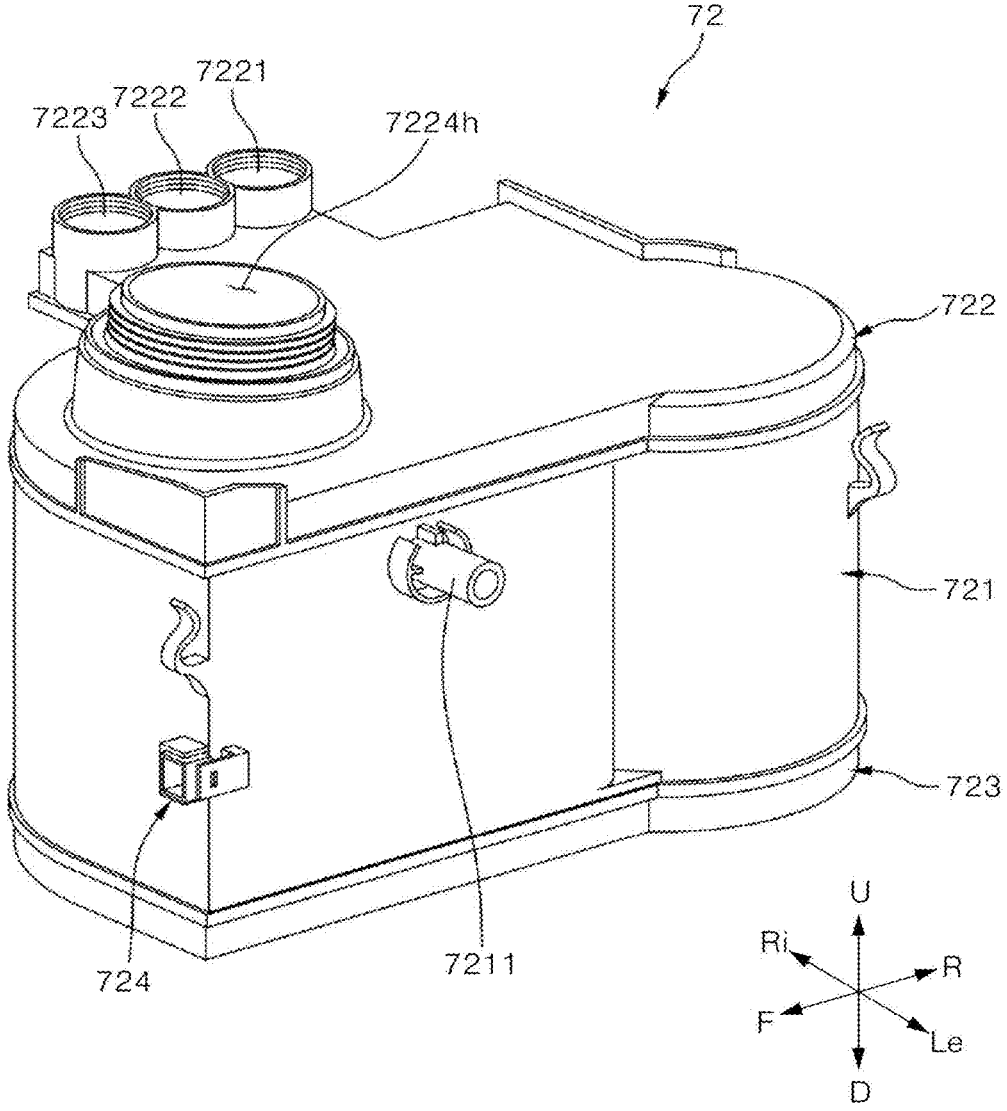
FIG. 15 is a front perspective view illustrating a relative arrangement position between a weight balance and the moisture sorption drying device.

More specifically, as illustrated in FIG. 14, the water softening device 72 may include a tank body 721 configured to define a space in which the washing water is accommodated, a tank cover 722 configured to block an opened upper side of the tank body 721, and a tank base 723 configured to block an opened lower side of the tank body 721.

The inside of the tank body 721, which constitutes the water softening device 72, may be divided into two opposite left and right sides as a whole, such that a regeneration tank and an exchange tank may be formed.

The exchange tank may define a space in which an ion exchange resin for softening the introduced washing water is accommodated.

The tank cover 722 may be mounted at an upper side of the tank body 721, and the tank base 723 may be mounted at a lower side of the tank body 721, such that an upper surface and a lower surface of the exchange tank 726 may be defined. That is, the opened upper and lower sides of the exchange tank 726 formed in the tank body 721 may be blocked by the tank cover 722 and the tank body 721.

The tank cover 722 may have a water inlet port 7221, a recovery port 7222, and a water outlet port 7223 through which the washing water flows inward and outward.

The washing water, which is provided from the water jacket 110 and to be supplied to the sump 41, may be temporarily stored in the tank body 721 of the water softening device 72 having the above-mentioned structure.

The water softening device 72 is configured to be connected directly to and communicate directly with the water jacket 110 to receive the washing water. Therefore, the water softening device needs to be disposed to be as close as possible to the water jacket 110. To this end, the water softening device 72 may be disposed between the sump 41 and the water jacket 110 based on the leftward/rightward direction.

Therefore, based on the sump 41 disposed at an approximately central side of the installation space of the base 90, the water jacket 110 and the water softening device 72 are disposed at positions biased toward the sump 41 in the rightward direction.

That is, as illustrated in FIG. 16, the installation space of the base 90 may be divided into a first space A1 passing through a center of the sump 41 and formed between the left surface 94 of the base 90 and an imaginary vertical plane VP extending in the forward/rearward direction, and a second space A2 formed between the imaginary vertical plane VP and the right surface 95 of the base 90. The water jacket 110 and the water softening device 72 are disposed in the second space A2 as a whole.

Therefore, the water jacket 110 and the water softening device 72, which store a significant amount of washing water, act as an eccentric weight to the dishwasher 1.

The above-mentioned eccentric weight is highly likely to act as a factor that worsens noise and vibration generated during the operation of the dishwasher 1.

In this regard, as described above, the blowing part 82, the heater part 83, and the moisture absorbent 85, which constitute the moisture sorption drying device 80 of the dishwasher 1 according to the embodiment of the present invention, may be arranged to be very adjacent to the rear surface of the base 90 and disposed in the installation space of the base 90 so that the blowing part 82, the heater part 83, and the moisture absorbent 85 are sequentially arranged in this order while being disposed in the leftward/rightward direction from the right surface 95 of the base 90 toward the left surface 94 of the base 90.

Because the blowing part 82, the heater part 83, and the moisture absorbent 85 are arranged in the above-mentioned order, the moisture absorbent 85, which accounts for the highest weight ratio among the components of the moisture sorption drying device 80, may be disposed to be closer to the left surface 94 of the base 90 than the sump 41 based on the leftward/rightward direction in the state in which the moisture absorbent 85 is accommodated in the moisture absorbent accommodation portion 8412, as illustrated in FIG. 16.

Further, the moisture absorbent 85 and the moisture absorbent accommodation portion 8412 may be configured to be disposed in the first space A1, as a whole, in the installation space of the base 90.

In this case, as illustrated, the blowing part 82 may be disposed in the second space A2 as a whole, a part of the heater part 83 may be disposed in the first space A1, and the remaining part of the heater part 83 may be disposed in the second space A2.

In addition, the washing pump 45, which accounts for a relatively high weight ratio among the components disposed in the installation space of the base 90, may also be disposed in the first space A1 as a whole together with the moisture absorbent accommodation portion 8412.

Therefore, the moisture absorbent 85, the moisture absorbent accommodation portion 8412, and the washing pump 45 are disposed to be opposite to the water jacket 110 and the water softening device 72 based on the sump 41, such that the weight, which is biased by the water jacket 110 and the water softening device 72, may be dispersed, which may minimize noise and vibration that may be caused by the eccentric weight.

Meanwhile, because the moisture absorbent 85 and the moisture absorbent accommodation portion 8412, which accounts for the highest weight ratio, are disposed in the first space A1 as described above, a center of gravity CM1 of the moisture sorption drying device 80 may be provided in the first space A1.

More specifically, as illustrated in FIG. 16, the center of gravity CM1 of the moisture sorption drying device 80 may be provided on the moisture absorbent accommodation portion 8412 so as to be adjacent to the heater part 83.

That is, the center of gravity CM1 of the moisture sorption drying device 80 may be provided to be closer to the left surface 94 of the base 90 than the right surface 95 of the base 90 based on the leftward/rightward direction.

However, as described above, the center of gravity CM1 of the moisture sorption drying device 80 is provided at a position spaced apart leftward from the imaginary vertical plane VP, which passes through the center of the sump 41, based on the leftward/rightward direction. However, the center of gravity CM1 of the moisture sorption drying device 80 may be provided at a position much closer to the imaginary vertical plane VP than the left surface 94 of the base 90.

Likewise, the center of gravity of the weight balance 99, which is disposed rearward of the moisture sorption drying device 80, is positioned at a position spaced apart leftward from the imaginary vertical plane VP. However, the center of gravity of the weight balance 99 may be provided at a position much closer to the imaginary vertical plane VP than the left surface 94 of the base 90.

That is, the center of gravity CM1 of the moisture sorption drying device 80 and a center of gravity CM2 of the weight balance are provided in the first space A1 to disperse the weight, but an interval from the center of the installation space of the base 90 in the leftward/rightward direction may be minimized.

Because the center of gravity CM1 of the moisture sorption drying device 80 and the center of gravity CM2 of the weight balance are provided to be as close as possible to the imaginary vertical plane VP as described above, the function of the counterweight for preventing the dishwasher 1 from falling over with respect to the center of the installation space of the base 90 may be effectively maintained.

The center of gravity CM2 of the weight balance 99 is illustrated as being positioned at the position further spaced apart leftward from the imaginary vertical plane VP than the center of gravity CM1 of the moisture sorption drying device 80. However, this is provided for illustrative purposes only. The center of gravity CM2 of the weight balance 99 may be set to vary depending on the weight of the moisture absorbent 85, the size of the moisture absorbent accommodation portion 8412, and the volume/weight of the weight balance 99.

While the present invention has been described above with reference to the accompanying drawings, the present invention is not limited to the drawings and the embodiments disclosed in the present specification, and it is apparent that the present invention may be variously changed by those skilled in the art without departing from the technical spirit of the present invention. Further, even though the operational effects of the configurations of the present invention have not been explicitly disclosed and described in the description of the embodiment of the present invention, the effects, which can be expected by the corresponding configurations, should, of course, be acceptable.

DESCRIPTION OF REFERENCE NUMERALS

1: Dishwasher 10: Casing
20: Tub 30: Door

40: Drive part 50: Accommodation part
60: Spray part 80: Moisture sorption drying device
90: Base 110: Water jacket

The invention claimed is:

1. A dishwasher comprising:
a tub having a washing space therein;
a base disposed below the tub and configured to define a predetermined installation space;
a sorption drying device accommodated in the installation space and configured to absorb moisture from air discharged from the tub and resupply the air into the tub; and
a sump accommodated in the installation space and configured to store washing water to be provided to the washing space,
wherein the sorption drying device comprises:
a blowing part configured to generate an airflow by accelerating the air discharged from the tub;
a heater part configured to heat the air having passed through the blowing part; and
an absorbent configured to absorb water vapor contained in the air having passed through the heater part, and
wherein the blowing part, the heater part, and the absorbent are disposed in the installation space based on a forward/rearward direction so as to be arranged between the sump and a rear surface of the base in a leftward/rightward direction.

2. The dishwasher of claim 1, wherein the blowing part, the heater part, and the absorbent are arranged in this order while being disposed in the leftward/rightward direction from one side surface of the base toward the other side surface disposed to be opposite to one side surface.

3. The dishwasher of claim 1, wherein the sorption drying device further comprises a housing having a heater accommodation portion for accommodating the heater part, and a absorbent accommodation portion for accommodating the absorbent, and
wherein the absorbent accommodation portion is disposed to be closer to the other side surface of the base than the sump based on the leftward/rightward direction.

4. The dishwasher of claim 3, wherein the installation space comprises:
a first space formed between the other side surface of the base and an imaginary vertical plane passing through a center of the sump and extending in the forward/rearward direction; and
a second space formed between the imaginary vertical plane and one side surface of the base, and
wherein the absorbent accommodation portion is disposed in the first space as a whole.

5. The dishwasher of claim 4, wherein the blowing part is disposed in the second space as a whole, a part of the heater part is disposed in the first space, and the remaining part of the heater part is disposed in the second space.

6. The dishwasher of claim 4, further comprising:
a washing pump configured to pressurize the washing water stored in the sump and supply the washing water to the washing space,
wherein the washing pump is disposed in the first space together with the absorbent accommodation portion.

7. The dishwasher of claim 3, further comprising:
a weight balance accommodated in the installation space and disposed between the sorption drying device and the rear surface of the base,
wherein a weight of the weight balance is smaller than a weight of the sorption drying device.

8. The dishwasher of claim 7, wherein a volume of the absorbent accommodation portion is smaller than a volume of the weight balance.

9. The dishwasher of claim 7, wherein a center of gravity of the weight balance and a center of gravity of the sorption drying device are provided to be closer to the other side surface of the base than one side surface of the base based on the leftward/rightward direction.

10. The dishwasher of claim 9, wherein the center of gravity of the sorption drying device is formed on the absorbent accommodation portion.

11. The dishwasher of claim 3, wherein a weight of the absorbent accommodated in the absorbent accommodation portion is within a range of 0.8 to 2 kg.

12. The dishwasher of claim 11, wherein a weight of the absorbent accommodated in the absorbent accommodation portion is within a range of 1 to 1.8 kg.

13. The dishwasher of claim 3, further comprising:
a water jacket disposed outside one side surface of the tub and configured to store the washing water,
wherein the water jacket is coupled to one side surface of the tub and extends in a downward direction toward the other side surface of the base.

14. The dishwasher of claim 13, further comprising:
a water softening device configured to soften the washing water stored in the water jacket and washing water provided from an external water supply source and provide the washing water to the sump,
wherein the water softening device is disposed between the water jacket and the sump based on the leftward/rightward direction.

15. The dishwasher of claim 13, wherein a capacity of the washing water discharged from the water softening device or stored in the water jacket is within a range of 1 to 2 liters.

16. The dishwasher of claim 15, wherein the capacity of the washing water discharged from the water softening device or stored in the water jacket is less than 2 liters.

17. The dishwasher of claim 1, wherein the tub has an air suction hole through which air to be introduced into the blowing part passes, and an air supply hole through which air having passed through the absorbent passes, and
wherein the air suction hole is formed in one side surface of the tub.

18. The dishwasher of claim 17, wherein the air supply hole is formed in a lower surface of the tub.

19. The dishwasher of claim 17, wherein the air suction hole is formed at a position on one side surface of the tub that is closer to a rear surface of the tub than the sump.

20. The dishwasher of claim 17, wherein the air supply hole is formed at a position on the lower surface of the tub that is closer to a rear surface of the tub than the sump.

* * * * *